United States Patent [19]

Rush

[11] 4,361,301

[45] Nov. 30, 1982

[54] VEHICLE TRAIN TRACKING APPARATUS AND METHOD

[75] Inventor: Donald L. Rush, Penn Hills, Pa.

[73] Assignee: Westinghouse Electric Corp., Pittsburgh, Pa.

[21] Appl. No.: 195,279

[22] Filed: Oct. 8, 1980

[51] Int. Cl.[3] ..... B61L 23/30

[52] U.S. Cl. ..... 246/34 R; 104/298; 340/47; 364/436

[58] Field of Search ..... 340/47, 23, 24; 364/436, 447, 443; 246/34 R, 40; 104/298, 295, 26 B, 26 R

[56] References Cited

U.S. PATENT DOCUMENTS

| | | | |
|---|---|---|---|
| 3,639,754 | 2/1972 | Kovalcik et al. | 246/182 B |
| 3,740,548 | 6/1973 | Hoyler | 246/3 |
| 3,895,584 | 7/1975 | Paddison | 104/88 |
| 3,963,201 | 6/1976 | Baumberger et al. | 246/34 R |
| 3,979,092 | 9/1976 | Perry et al. | 246/34 R |
| 4,007,897 | 2/1977 | Auer, Jr. | 246/187 B |
| 4,023,753 | 5/1977 | Dobler | 246/5 |

OTHER PUBLICATIONS

Thorne-Booth, "Signalling of Remotely Controlled Railway Trains," *IEEE Transactions on Comm. Tech.*, Jun. 1968, pp. 369-374.

Costa & Kalra, "Sao Paulo Metro E-W Line Innovations," *Conf. Record of 12th Ann. IEEE IAS*, pp, 1105-1109.

Sehs, "Atlanta Airport People Mover," *Conf. Record of 28th IEEE Vehicular Tech. Group*, Mar. 1978, pp. 1-10.

*Primary Examiner*—Glen R. Swann, III

*Attorney, Agent, or Firm*—R. G. Brodahl

[57] ABSTRACT

A vehicle train tracking apparatus and method are provided for responding to detected occupancies and unoccupancies of each of a plurality of signal blocks of a roadway track system to establish a position or location record of the movement of each vehicle train operating with the roadway track system.

25 Claims, 33 Drawing Figures

SWITCH BLOCK TABLE 902

| | | | | |
|---|---|---|---|---|
| TK3 | 8 | WORD | BIT | SWITCH POSITION |
| | 0 | WORD | BIT | NOR DIRECTION |
| | 0 | WORD | BIT | EAST 2TOCC |
| | 0 | TRLOC ADDRESS | | 2T LOC IN TRLOC |
| | 0 | WORD | BIT | WEST 4TOCC |
| | 0 | WORD | BIT | 4T LOC IN TRLOC |
| | 0 | WORD | BIT | REV DIRECTION |
| | 0 | WORD | BIT | EAST 2TOCC |
| | 0 | TRLOC ADDRESS | | 2T LOC IN TRLOC |
| | 0 | WORD | BIT | WEST 5TOCC |
| | 0 | TRLOC ADDRESS | | 5T LOC IN TRLOC |

FIG.16A

NONSWITCH BLOCK TABLE 900

| | | | | |
|---|---|---|---|---|
| TK2 | 0 | WORD | BIT | DIRECTION |
| | 0 | WORD | BIT | EAST 1TOCC |
| | 0 | TRLOC ADDRESS | | 1T LOC IN TRLOC |
| | 0 | WORD | BIT | WEST 3TOCC |
| | 0 | TRLOC ADDRESS | | 3T LOC IN TRLOC |

FIG.16B

TRACK CIRCUIT BECAME OCCUPIED 904

| | |
|---|---|
| TKTOI | |
| | |
| | |
| | |

FIG.16C

TRACK CIRCUIT BECAME UNOCCUPIED 906

| | |
|---|---|
| TKTOZ | |
| | |
| | |
| | |

FIG.16D

FALSE OCCUPANCY ALARM TABLE 908

| | |
|---|---|
| FALSE | |
| | |
| | |
| | |

FIG.16E

DROPOUT OCCUPANCY ALARM TABLE 910

| | |
|---|---|
| DROP | |
| | |
| | |
| | |

FIG.16F

DIRECTIONS INPUTS 912

| | |
|---|---|
| DIRIN | |
| | |

FIG.16G

GATES JUST CLEARED 914

| | |
|---|---|
| GKTOI | |
| | |

FIG.16H

SWITCH POSITION INPUTS 916

| | |
|---|---|
| SWIN | |
| | |

FIG.16I

CONSTRUCTED DIRECTION TABLE 252

| | F | E | D | C | B | A | 9 | 8 | 7 | 6 | 5 | 4 | 3 | 2 | 1 | 0 |
|---|---|---|---|---|---|---|---|---|---|---|---|---|---|---|---|---|
| DIR | | | | | | | | | | | | | | | | |

BIT 0 = SPARE
BIT 1 = SPARE
BIT 2 = 1,2,3 TK
BIT 3 = 4 TK
BIT 4 = 5A-12 TK
BIT 5 = 13 TK
BIT 6 = 14 TK
BIT 7 = 15 TK
BIT 8 = 16 TK
BIT 9 = 17-21 B TK
BIT A = 22 TK
BIT B = 23,24 TK
BIT C = 25 TK
BIT D = SPARE
BIT E = SPARE
BIT F = SPARE

| | F | E | D | C | B | A | 9 | 8 | 7 | 6 | 5 | 4 | 3 | 2 | 1 | 0 |
|---|---|---|---|---|---|---|---|---|---|---|---|---|---|---|---|---|
| DIR+1 | | | | | | | | | | | | | | | | |

BIT 0 = SPARE
BIT 1 = SPARE
BIT 2 = 26,27 TK
BIT 3 = 28,29 TK
BIT 4 = 30A-35 TK
BIT 5 = 36 TK
BIT 6 = 37 TK
BIT 7 = 38 TK
BIT 8 = 39 TK
BIT 9 = 40-46 TK
BIT A = 47 TK
BIT B = 48,49 TK
BIT C = 50 TK
BIT D = 51 TK
BIT E = SPARE
BIT F = SPARE

FIG. 16J

263 TRAIN # IN TRACK CIRCUIT

| TRLOC | |
|---|---|
| | SPARE |
| | SPARE |
| | 1T |
| | 2T |
| | 3T |
| | ⋮ |
| | 49T |
| | 50T |
| | 51T |
| | SPARE |
| | SPARE |

FIG. 16K

263 TRLOC ADDRESS TABLE

| TABADD | |
|---|---|
| | SPARE |
| | SPARE |
| | TK1 ADDRESS |
| | TK2 ADDRESS |
| | TK3 ADDRESS |
| | ⋮ |
| | TK49 ADDRESS |
| | TK50 ADDRESS |
| | TK51 ADDRESS |
| | SPARE |
| | SPARE |

FIG. 16L

VEHICLE TRAIN TRACKING APPARATUS AND METHOD

CROSS REFERENCE TO RELATED APPLICATION

The present application is related to a patent application Ser. No. 195,261 that was filed concurrently herewith by D. L. Rush and entitled "Vehicle Train Routing Apparatus and Method", which is assigned to the same assignee and the disclosure of which is incorporated herein by reference.

BACKGROUND OF THE INVENTION

It is known in the prior art to provide an identification system on a train to enable the progression tracking of that train moving along a roadway track. For example it is known for vehicle trains, such as operative with the BART system in San Francisco as described in an article published in December 1967 in Railway Signaling and Communications at pages 18 to 23, in an article published in March 1970 in Westinghouse Engineer at pages 51 to 54 and in an article published in September 1972 in Westinghouse Engineer at pages 145 to 151, to include a train identification system on every train that actively or passively provides an identification to each station when a given train enters that station. It is known for vehicle trains, such as operative with the Seattle-Tacoma International Airport as described in an article published in January 1971 in Westinghouse Engineer at pages 8 to 14, to include a radio carried by every train to actively provide an identification to each station entered by that train. For a steel wheel vehicle train it is known for the wheels of each vehicle operated to provide an electrical shunt between the steel tracks of the roadway track system to determine the vehicle train movement and for a rubber tired vehicle train, it is known to utilize suitable contact devices which operate with signal conductors to provide an electrical shunt between those conductors to determine the vehicle train movement.

The present invention is intended to be first applied to control vehicle trains in relation to the guideway transit system supplied for the Atlanta Hartsfield International Airport. Some publications relating to the transit system equipment provided for the Atlanta Airport are (1) Atlanta Airport Automated Guideway Transit System by John Kapala for the ASCE Convention in Atlanta, Ga., Oct. 23-25, 1979.

(2) Recent Applications of Microprocessor Technology To People Mover Systems by M. P. McDonald et al for the IEEE Vehicular Technology Group Conference in Chicago, Ill., Mar. 28, 1979.

(3) Atlanta Airport People Mover by T. C. Selis for the IEEE Vehicular Technology Group Conference in Denver, Colo., Mar. 24, 1978.

SUMMARY OF THE INVENTION

The present invention relates to tracking the movement of a vehicle train along a roadway track system including a plurality of track circuit signal blocks by detecting when each track circuit signal block becomes occupied and when it becomes unoccupied by removing a previous electrical shunt in relation to the signal block, and using this information to move an identification of that vehicle train through a location or position memory record table in accordance with the position movement of the vehicle train through the successive track circuit blocks. This enables detecting a false occupancy and enables detecting a dropout of the vehicle train in relation to any track circuit block of the system.

A record table of track circuit train movement directions is established in relation to signals from interlocking, gate signals clearing and turnback operations.

BRIEF DESCRIPTION OF THE DRAWINGS

FIGS. 16A to 16L show the information tables utilized with the program routines of FIGS. 11 to 15;

GENERAL OPERATIVE DESCRIPTION OF THE TRAIN TRACKING APPARATUS AND METHOD

Figure 1:
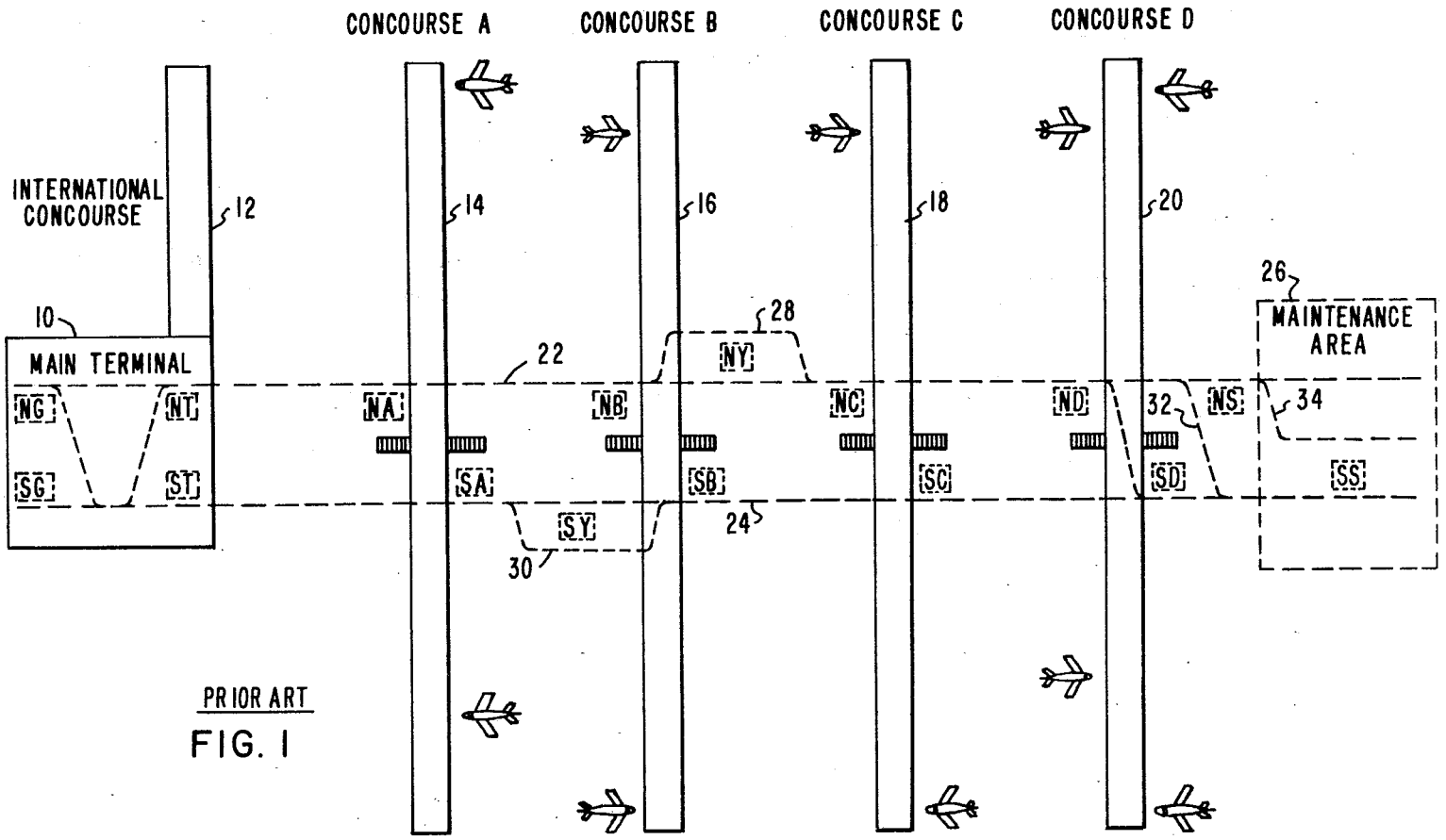
PRIOR ART FIG. 1
FIG. 1 shows a prior art physical arrangement of a typical track system.

The function of the train tracking apparatus and method is to detect train movements around the system, to move the train numbers with the train on a track circuit block by track circuit block basis, to detect false occupancies and to detect occupancy dropouts. An added feature is to detect and alarm late trains, which have not arrived at a given point after some arbitray time since leaving some other given point, which train late alarm is on a station-to-station basis.

In order to track trains around the system, the direction of travel must be known at the time a track circuit becomes occupied and also at the time the track circuit becomes unoccupied. Direction of travel is not available from interlocking except when a route is cleared. The direction for each track circuit is established by the here described tracking program. A direction table is set up, with each track circuit having a bit assigned to it. A 1 is for westbound and a 0 is for eastbound traffic. These bits are set or reset based on the clearing of a gate or a change of state of a direction input bit. When a gate clears, all affected track circuit direction bits are put to the desired state. These bits remain unchanged until the clearing of another gate causes them to be changed or until the train enters a station block with the turnback pushbutton activated. This will cause the direction input bits to be changed. At all times each track circuit has a bit in the direction table defining the direction of travel established for that specific track circuit block.

Trains are tracked around the system based on track circuits becoming occupied and track circuits becoming unoccupied, and tables are used for each such state, with table TKT01 for track circuits going from 0 to 1, and table TKT0Z for track circuits going from 1 to 0. When a track circuit becomes occupied, a check is made of the status of the track circuit behind it based on the direction table. If the previous track circuit was occupied, the present occupancy is legitimate. The train number from the previous track circuit is moved into the present track circuit. If the previous track circuit was not occupied, the present track circuit indication is a false occupancy and is alarmed. This is true for all circuits except 25T (FIG. 3C), since a train can legally appear in this track circuit from the maintenance area. When a false occupancy is detected, it is assigned a pseudo train number and an alarm is generated.

An estimated 95 percent or more of false occupancies can be detected in the manner described. Several undefined areas exist. One example is a false occupancy occurring in the block ahead of a train. This will be assumed to be a real occupancy because the previous block is occupied.

When a track circuit becomes unoccupied, the track circuit ahead, based on the direction table status bit, is checked for occupancy. If the next block is occupied, the train has moved forward and is now out of the present circuit. The train number in the present track circuit is removed. If the next block is not occupied, the loss of the indication is assumed to be a dropout and will cause an alarm. Once again track circuit 25T in the eastbound direction is an exception.

Not all dropouts can be detected. One example is a train located in two tracks circuits and a dropout occurring in the rear block. This will appear to be a legitimate loss of indication.

The vehicle train tracking apparatus and method includes a digital computer program that is executed once each main program loop and each track circuit is checked for both cases, becoming occupied and becoming unoccupied. At the end of the program execution, train numbers in the train location table have been changed to reflect any movement from block to block, false occupancies have been detected and alarmed, and dropouts have been detected and alarmed.

DESCRIPTION OF A PREFERRED EMBODIMENT

FIG. 1 shows a prior art physical arrangement diagram of the new international airport complex in Atlanta, Ga. which is presently under construction. The main terminal 10 is at the west end. The international concourse 12 is north of the main terminal 10. Toward the east are four long narrow concourses 14, 16, 18 and 20 for the planes to load and unload passengers. Underground and running through the center from the terminal building 10 all the way up through concourse 20 is an underground transit system, including a first track 22 and a second track 24. To the east of concourse 20 is an underground maintenance area 26, which is large enough to store and repair transit cars. Normally, the passengers will come into the parking lots on either side of the main terminal 10 and go inside to the ticketing area, where they will obtain tickets and check baggage before going down to the lower area where the transit system is located to carry them to the proper concourse for catching an airplane. Coming back from one of the concourses, passengers ride an escalator down to the transit system and catch the next train that comes along for riding to the baggage area to pick up baggage and go into the main terminal and leave.

The normal direction movement of the vehicle trains is counterclockwise. A typical train will start at station NG on the north track 22, and cross over through the switches to the south track 24 before stopping at the station ST. The train then moves through stations SA, SB, SC and SD. At this point the train will reverse and cross over through the switches to the north track 22, stopping at stations ND, NC, NB and NA. The system can be set up to skip north ticket NT and go straight to north baggage NG. That is the normal mode of operation. It is desired that this system keep running regardless of most breakdowns or the like, so the computer control provides various backup modes of operation. Instead of using the turn back point in the north baggage station NG, the train can go to the south baggage station SG. And on the other end, instead of using the south track station SD, the train can use south spur turnback SS, which is a pseudo station in the maintenance area 26 to the east of south track station SD, in case there is switch problem on the cross over between stations SD and ND. If there is a train broken down on either one of the north track 22 or the south track 24, there can be provided a shuttle mode, where a given train will go back and forth down each individual track 22 or 24 in shuttle fashion between any two or more stations on that track. For operation on off peak hours, sometimes one track will be shut down for maintenance and two trains can run on the other track using the bypass 28 for north track 22 and the bypass 30 for south track 24 as the cross over point. There are twelve regular stations where a train can stop and load or unload passengers, and there are four pseudo stations SY, NY, SS and NS. The pseudo stations are treated in the tracking program like a regular station, except the doors can't open for a train stopped in a pseudo station. The pseudo station NY is located on the north bypass leg 28, station SY is in the south bypass leg 30, station SS is in the south spur on the south track 24 and station NS is in the north storage area which lies to the east of station ND between the two switches 32 and 34.

Figure 2:
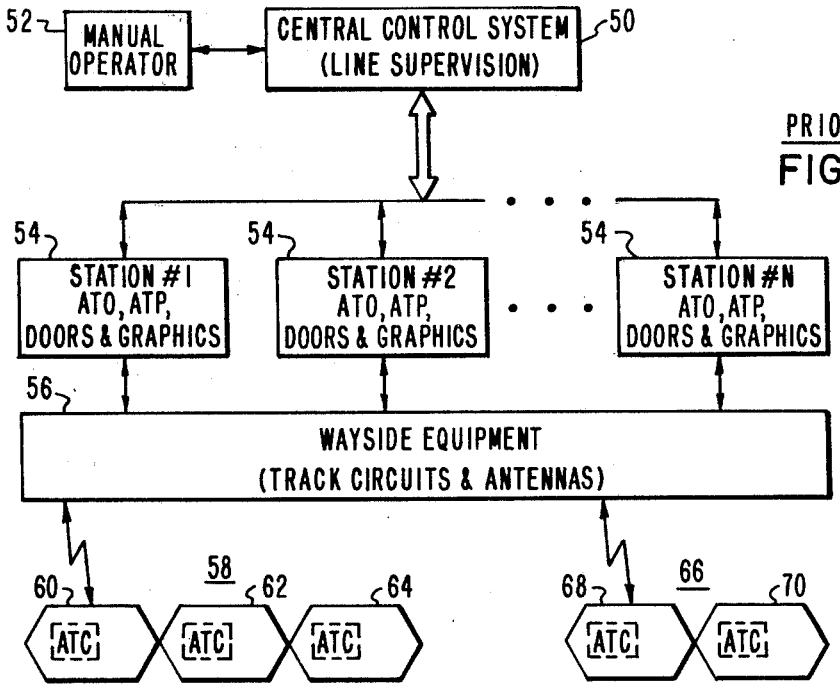
PRIOR ART FIG. 2
FIG. 2 shows a schematic block diagram of a prior art vehicle train control apparatus.

In FIG. 2 there is shown a prior art central control system 50, which can be located in a headquarters building and receives information about the transit system and individual vehicle train operation, and from a system manual operator 52 in relation to the desired performance of the individual vehicle trains. The central control system 50 supervises the schedule, spacing and routing of the individual trains. The passenger loading and unloading stations 54 are provided to operate with the central control system 50 as desired for any particular transit system. The wayside equipment 56 including track signal block circuits and associated antennas for speed commands, door control and program stop control signals is located along the vehicle track roadway between the stations and is provided to convey information in relation to passenger vehicle trains travelling along the roadway track. A first illustrative train 58 is shown including three vehicle cars 60, 62 and 64 and a second train 66 including two vehicle cars 68 and 70.

Each vehicle car includes an automatic train operation ATO and automatic train protection ATP apparatus to make up the automatic train control ATC apparatus carried by each vehicle car. The automatic train control ATC apparatus includes the program stop receiver module, the speed code receiver module, the vital interlock board and power supplies and all the modules required to interface with the other equipment carried by the train vehicle, and in accordance with the more detailed description set forth in the above-referenced publications.

Figure 3A:
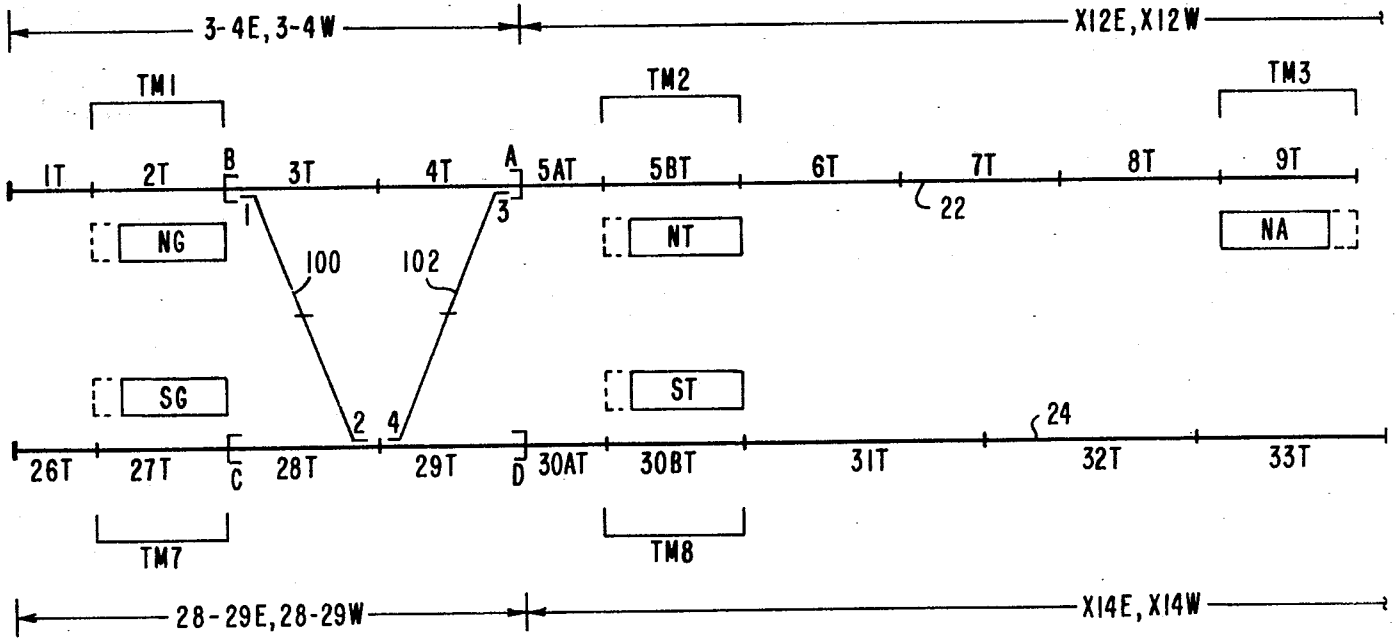
PRIOR ART FIG. 3A
FIG. 3A to 3C shows an illustrative track plan for the prior art track system of FIG. 1.
Figure 3B:
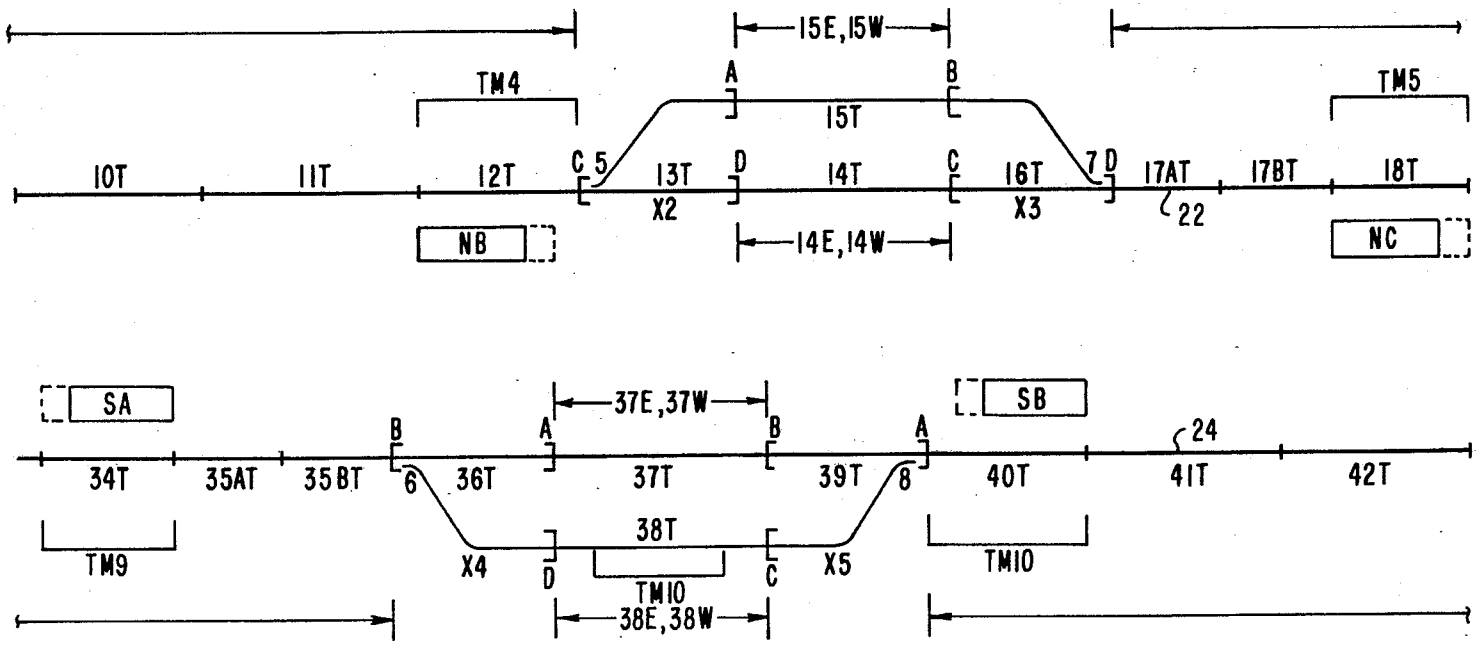
PRIOR ART FIG. 3B
Figure 3C:
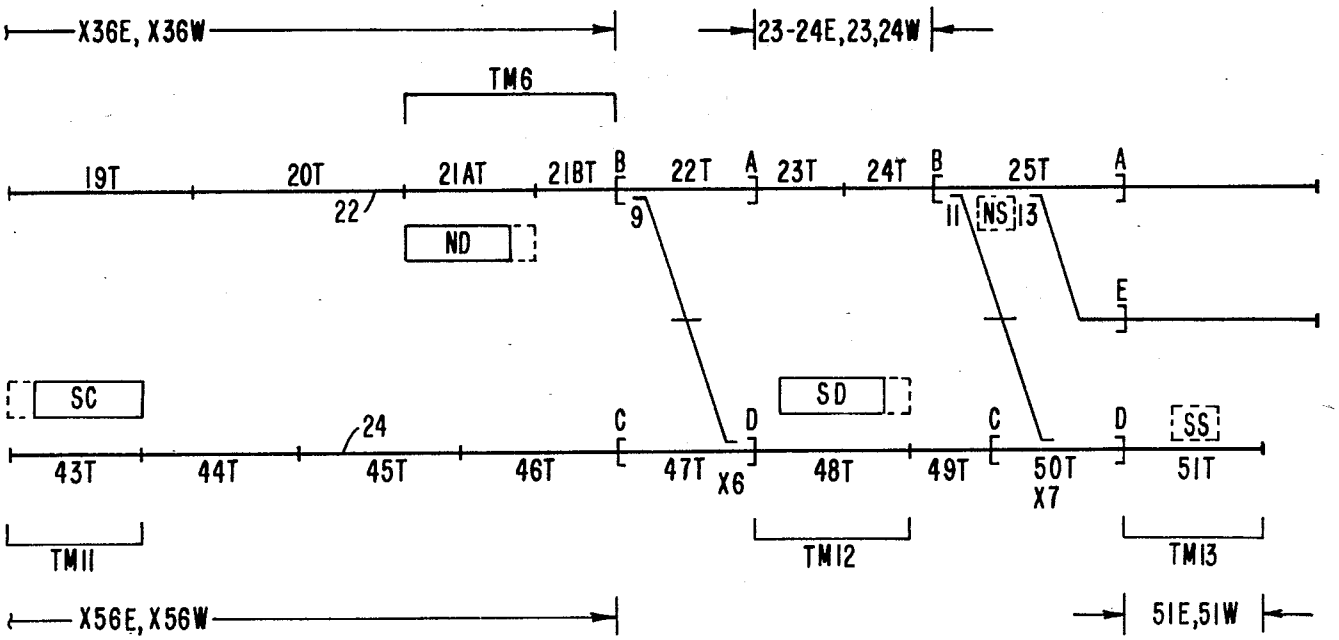
PRIOR ART FIG. 3C

FIGS. 3A, 3B and 3C show an illustrative prior art track plan for the airport complex shown in FIG. 1. It is the layout of all the track circuits, switches and other equipment required to run the vehicle train system. The physical track includes the first track 22 and the second track 24, where the trains run. The rectangle boxes NG, SG, NT, ST, NA, SA, NB, SB, NC, SC, ND and SD represent the passenger stations, with the dotted area of the end representing space provided for expansion. Along each track, there are cross marks dividing the track into track circuit signal blocks 1T, 2T, 3T, and so forth. The track circuit 1T is to the left of station NG. The track circuit 2T encloses the station NG. Crossovers 100 and 102 are provided to the right of stations NG and SG, with each having two switch machines as required to move a section of track for passing a train from one track to the other track. The small brackets around each of switches and labeled A, B, C and D are gates or traffic signals. The direction of traffic is always into the face of the bracket. Every switch has a traffic signal or gate in front of it to inform the train if it is permissible to move through the switch. The small numbers 1, 2, 3 and 4 refer to the adjacent switch. Above and below the tracks are longer parallel brackets labeled TM followed by a number, and these are terminal zones; the trains are allowed to turn around in these zones, for example if a train enters a terminal zone going west it can reverse direction in that same zone and return going east. These are train direction turn around locations. Above and below the track layout are direction signal areas that are used in the direction programs routine, such as 3-4E and 3-4W; if the E direction bit is a one, the train is going east, and if the W direction bit is a one, the train is going west. These direction bits are used to construct the DIR table, shown in FIG. 16B.

Figure 4:
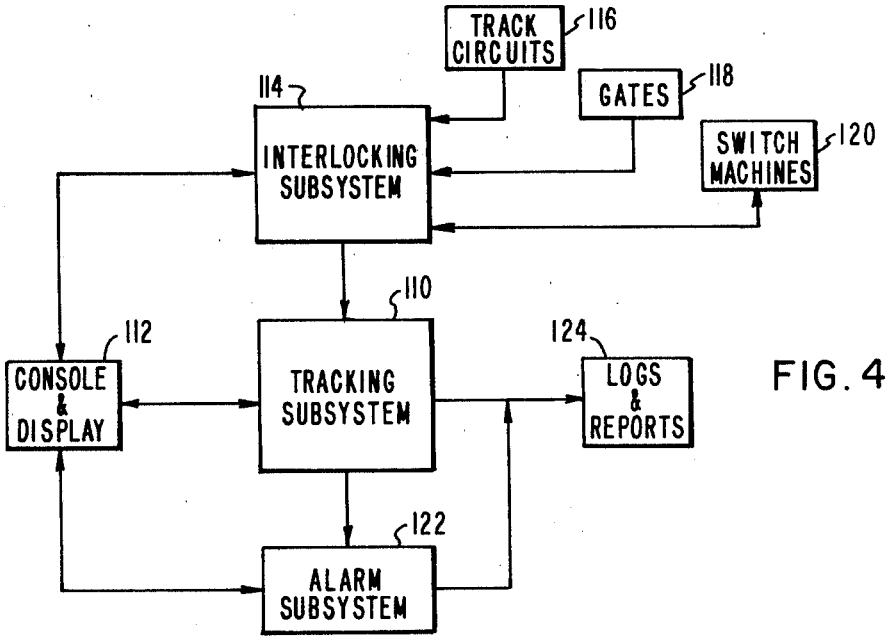
FIG. 4 shows the signal flow of the present invention.

FIG. 4 shows the train tracking signal flow of the present invention. The center block 110 shows the tracking subsystem, which includes the programmed digital computer, the inputs and outputs to the computer and the several program routines and subroutines. At the left side is the console and display 112. Information that goes from the console 112 to the tracking program within the tracking subsystem 110 are such things as each train number and the car numbers within each train to set up the system so the tracking subsystem can follow each of the trains around the track and keep track of them for the purpose of logging. This tracking subsystem 110 is different from those of the prior art, since there is no on board identification or ID system. Once the train is put on the track system shown in FIG. 3 this tracking subsystem keeps track of which train it was and what cars are in the train. On the display portion of the console 112, there are facilities to display the train number, car number for any train on the system, by requesting this information with the proper pushbuttons and switches on the operator's console. The interlocking subsystem 114 checks to see if it is safe to allow the train to make a move, and provides for the vehicle safety of the system. The information required for the interlocking subsystem 114 includes the track circuit information, the gate status and the switch positions and is operative with the track circuits 116, the gates 118 and the switch machines 120.

The tracking subsystem 110 gets information from the interlocking subsystem 114 to allow the tracking subsystem 110 to follow each train around the track system. A primary input is from each track circuit in regard to when the track circuit becomes occupied or becomes unoccupied; these are two signals that the tracking subsystem 110 uses to follow a train. It also has to have the switch position indications to know which path a train is going to take when it comes into a switch block. The interlocking subsystem 114 does not supply the direction input when needed, since the direction indication from interlocking 114 disappears at the time the track circuit becomes occupied, which is too early for the tracking subsystem 110 to use this direction information. Therefore, a direction table is constructed using the various track circuit direction indications and a program routine determines what direction the train is going in relation to every single block.

The information from the tracking subsystem 110 is used to provide an alarm to the alarm subsystem 122, if a train appears where it is not supposed to be, such as when a false occupancy of a track circuit shows up or if a train drops out of a track circuit, the operator needs to know this has happened. The tracking subsystem 110, provides a message when a false occupancy or a drop-out occurs, which is logged in the computer and is printed out on a typewriter in the logs and reports 124. The tracking subsystem 110 keeps track of every car, and every train on this track system from the time it enters until it leaves the track system.

When the operator enters the train and the car numbers from the console, he enters the train number and a car number for each car, and that information goes into permanent storage. So now every car that is within a particular train is known. The tracking subsystem 110 tracks by train number, when an operational problem occurs, the tracking subsystem 110 searches the original table to establish the train number and the vehicle cars involved with that problem. The interlocking subsystem 114 furnishes direction information for about $\frac{2}{3}$ of the track circuits. The interlocking subsystem 114 requires this direction information in order to allow a train to move safely. But, as soon as the train move is made, the direction information disappears because interlocking subsystem 114 does not need this information anymore. The tracking subsystem 110 must keep the direction information because when a block becomes unoccupied, the tracking subsystem 110 needs to know what direction the train is going, and this need could be seconds or even minutes after the interlocking direction information has disappeared. For example, an indication is sensed by the tracking subsystem 110 of track circuit 3 becoming occupied. The direction table is constructed before the operation of the tracking program, and is constructed in relation to each track circuit to include the following information: the direction bit indication is east, the direction bit indication is west, a gate is cleared in the east direction or a gate is cleared in the west direction. Assuming that the direction table is so constructed for track circuit 3, when the tracking subsystem 110 senses track circuit 3 becomes occupied, it checks the direction table so see which direction the train is going. If it is west, the track circuit to the east, track circuit 4, is checked to see if a train was previously there, and if not, this is a false occupancy.

If track circuit 4 is occupied, the train number in track circuit 4 is stored in the table for track circuit 3. The same train is now in both track circuits 3 and 4. In this example, the train moved into track circuit 3, which became occupied as soon as the train noses over into the track circuit 3 block. The direction of travel is known, so therefore the tracking subsystem 110 knows where it came from. It looks back to the previous track circuit 4 to see if that track circuit is occupied, when the train crosses the boundary two blocks have to be occupied. The tracking subsystem 110 knows that track circuit 3 is occupied by a particular train X . The next thing that is going to happen in the sequence for a moving train is track circuit 2 is going to become occupied, so now the tracking subsystem 110 looks back in the direction the train is coming from, track circuit 3, and there is a train there. The tracking subsystem 110 moves train X into block 2, so train X is now in blocks 3 and 2.

The next logical thing that happens is track circuit 3 will become unoccupied, and when it becomes unoccupied, the tracking subsystem 110 looks ahead in the direction the train is going, and if there is a train in track circuit 2, this is a proper operation so the train number is cancelled out of 3. If there is no train in track circuit 2, a dropout has occurred because the train which was supposed to be going into next block, did not. This dropout is alarmed. The tracking subsystem 110 follows each train one block at a time, all the way around the track system. All decisions are based on these things: the track circuit became occupied, the direction the train is moving and the track circuit became unoccupied. If there is a switch in the track circuit block, it adds another information check that has to be made.

Figure 5:
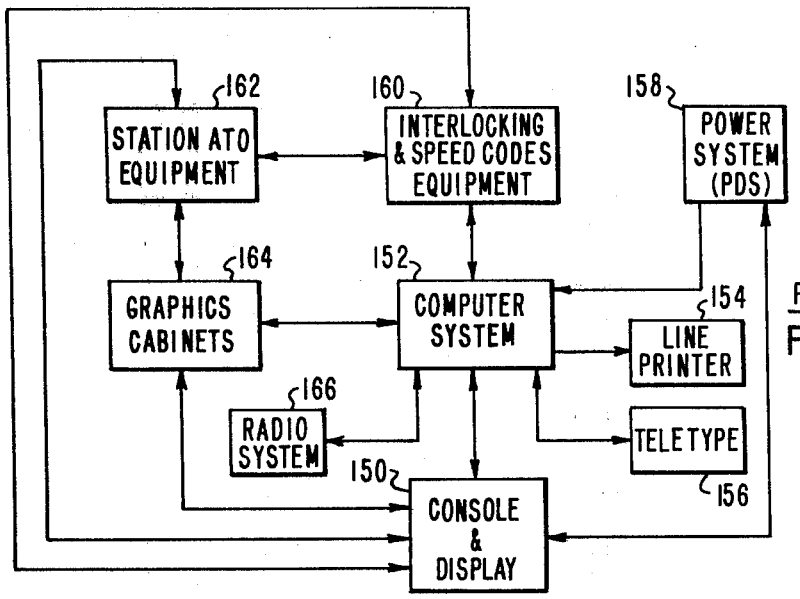
PRIOR ART FIG. 5
FIG. 5 shows a prior art central control system block diagram, for controlling vehicle trains.

FIG. 5 shows a prior art block diagram of the central control system 50 shown in FIG. 1. A console and display 150 is included and the operator inputs go into this console, with the status of the train system being shown on the display portion. The computer system 152 is described in more detail in relation to FIG. 6. The computer system 152 includes memory, input and output devices and the power supply. To the right of the computer block the line printer is used to print the reports and the teletype 156 is used to log all alarms and changes as they occur to provide a real time printout. The power system 158 controls the actual track power to the entire system, and includes relays and the inputs that go into the computer system 152 and also goes to the console and display 150. The control of the power system 158 does not go through the computer, but is hard wired directly to the console and display, with the status of the system going through the computer to allow the printout. The interlocking and speed control equipment 160 is well known and has been provided in many train control systems to establish where each train is going, when it is going and how fast it is going to go. The station ATO equipment 162 includes the non-vital relays associated with some of the train control and part of the graphics. A graphics cabinet 164 is the relay cabinet which controls the graphics for signs at each of the stations on the system. The radio system 166 can be a standard system which receives and transmits messages both data and voice to and from each of the cars on the system.

The previous interlocking equipment 160 provided a direction signal to determine if it was safe to allow a particular train to go from point A to point B if a switch was included in this path, then one or more of gates A, B, C and D are sensed depending on which direction the train is going. If there is a train at point A and it is desired that it go to point B, interlocking will look at each of the track circuits between A and B, and it will check any switch position located between A and B, and establish a direction for each involved track circuit between A and B. In advance, the route has to be cleared before the train can leave a given station, and the direction bit is used to determine if the train movement is safe. If it is safe, there are no trains ahead of it, and each switch is in the correct position, then interlocking will permit the train to move from A to B. Interlocking is finished with the direction bit before the tracking program needs this information. The reason is that interlocking is required before a train movement to clear a route and the tracking program waits until the train has actually moved into a given track circuit for tracking the train in relation to that track circuit. The route from A to B has to be cleared by interlocking before the train travels that route, and interlocking drops the direction information the instant the route is taken, so interlocking can start looking to clear the next route for the next move of the train. The interlocking equipment 160 is the train movement safety system and provides a direction indication for each track circuit through which the train is going to move. If interlocking gives a direction indication of west this means that the train is only allowed to go west.

Figure 6:
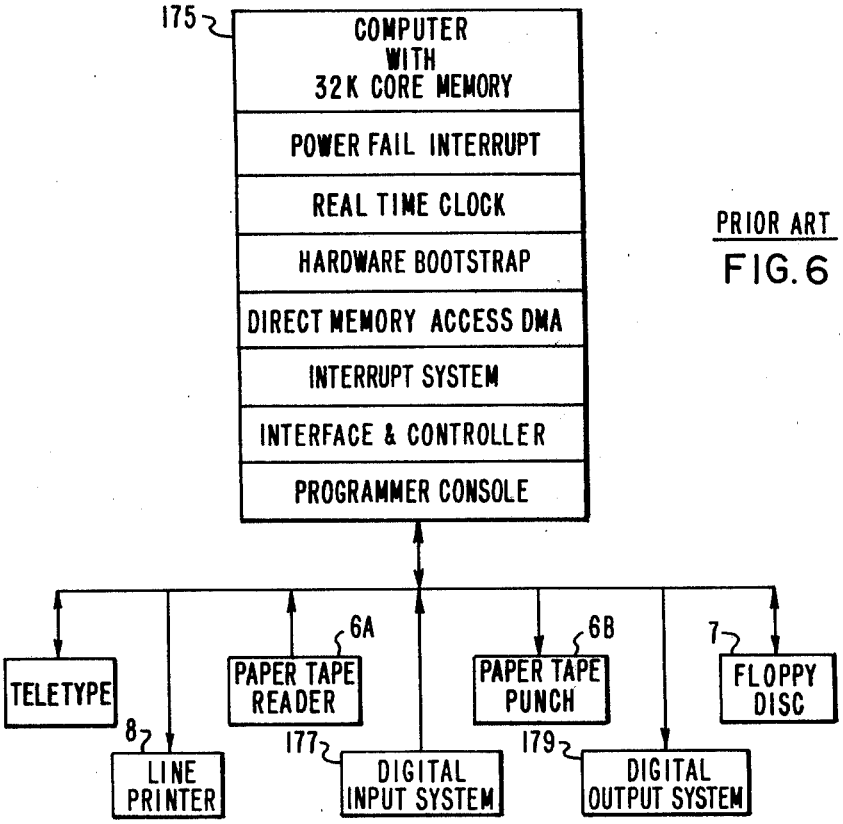
PRIOR ART FIG. 6
FIG. 6 shows a prior art computer system block diagram for controlling vehicle trains.

In FIG. 6 there is shown a prior art computer system 152 suitable for use with the present invention. A standard digital computer (LSI2-20) 175 can be purchased for this purpose in the open market from Computer Automation. It is a minicomputer provided with 32 K core memory. The selected options include a power fail interrupt that senses when the power drops below some certain level and provides orderly shutdown, a real time clock, a hardware bootstrap loader in case it is desired to load a new program manually, a direct memory access channel to allow high speed data transfer, an interrupt system and various interfaces and controllers. The provided peripherals include a teletype which is the real time logger, a paper tape reader, a paper tape punch, a floppy disc and a line printer. The digital input and digital output systems are available from Computer Automation and convey information to and from the rest of the system.

Figure 7:
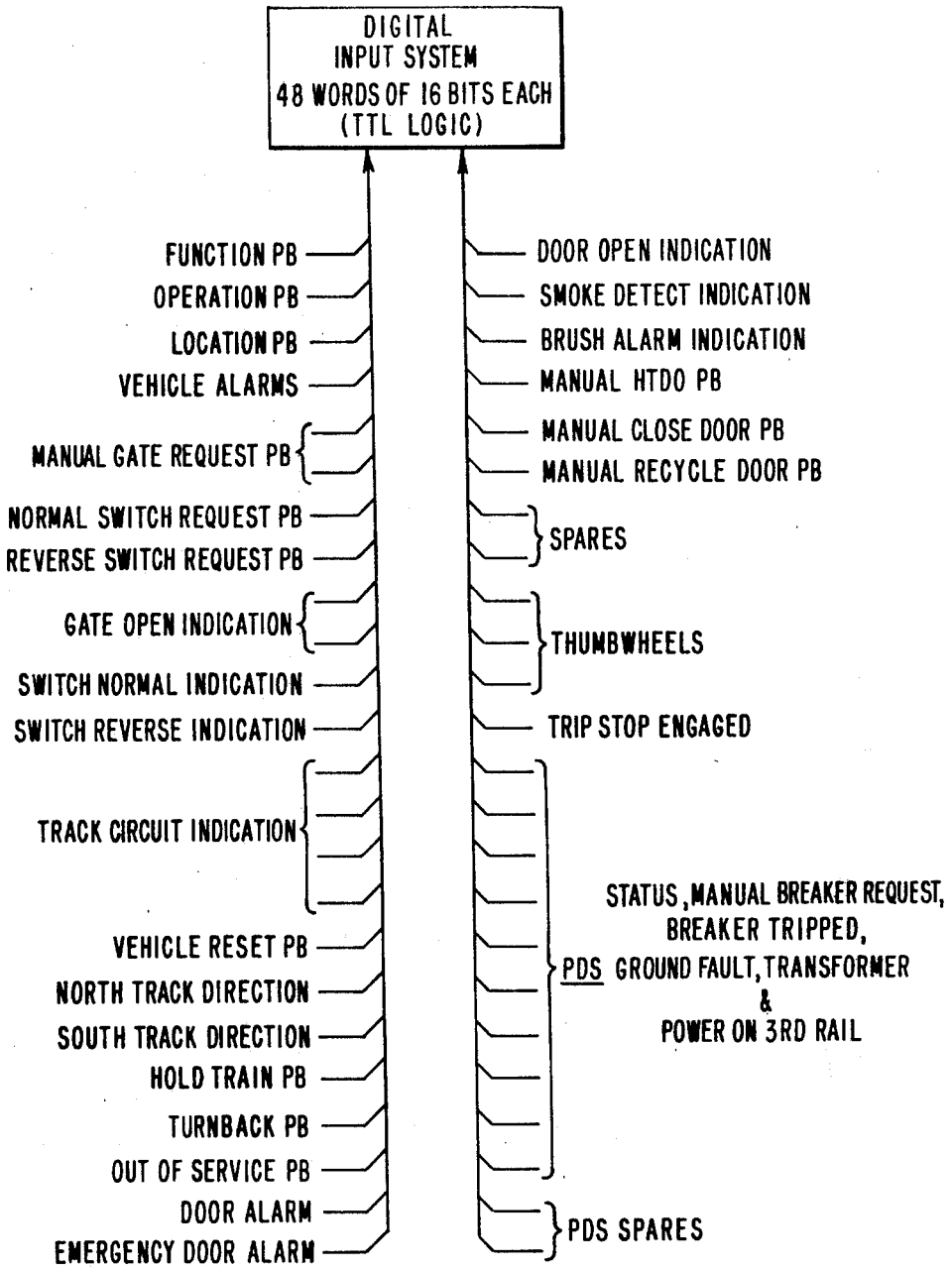
FIG. 7 shows the digital input signals of the present invention.

FIG. 7 shows the digital input signal system, and each of the illustrated signals represents 16 input bits. The first word on the left is the function pushbuttons, which are on the operator's console. The second word is the operation pushbutton, which is on the operator's console. The third word is the location pushbuttons which correspond with the twelve stations and four pseudo stations shown in FIG. 1. The fourth word is for vehicle alarms. Each of the other input words is identified by its name.

Figure 8:
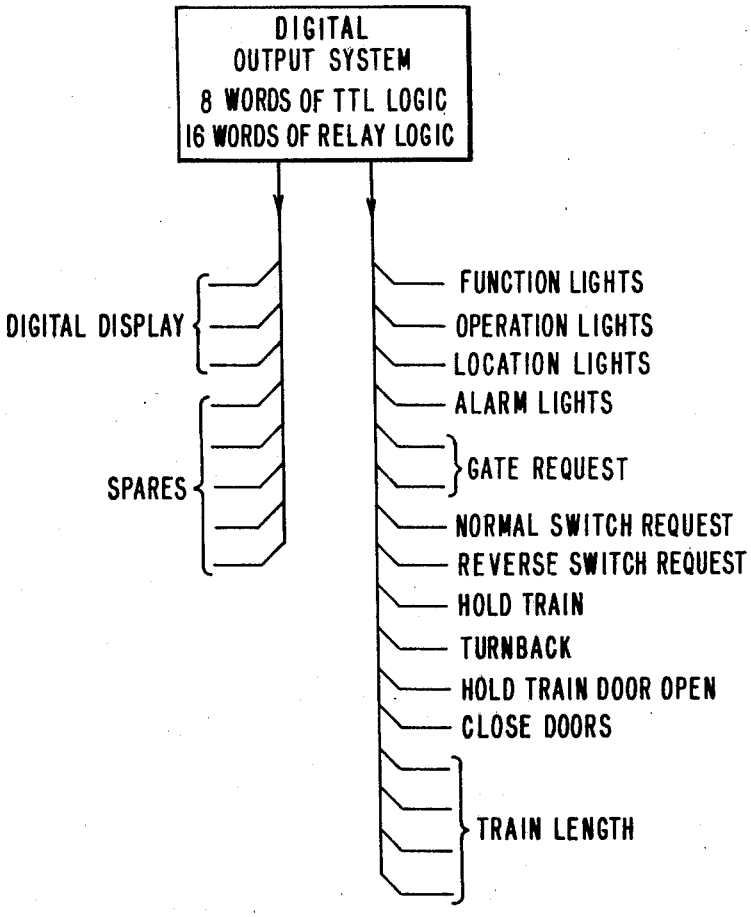
FIG. 8 shows the digital output signals of the present invention.

FIG. 8 shows the digital output signal system. There are two types of outputs on this system, one type is TTL logic, which is used to drive the digital displays and the other type output is a relay contact when there is a need for more power. Each of these output signals represents 16 bits of information. There are some spare words which are so illustrated.

Figure 9:
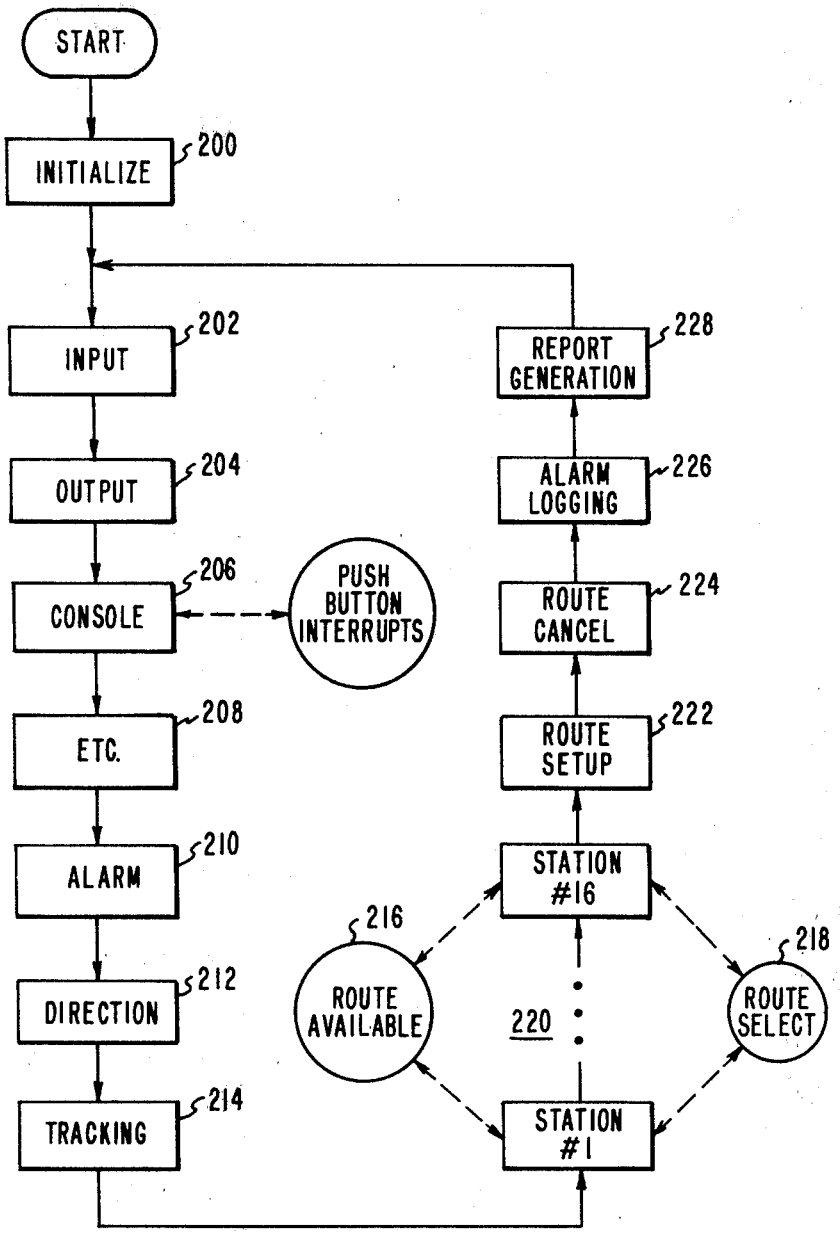
FIG. 9 shows the control system sequential operations including the control system of the present invention.

FIG. 9 shows the representation of the tracking program control program, with the sequence of the different sections of the programming. The tracking program in general uses a plurality of different routines which are all per se prior state of the art logic. The first block 200 is initialization, which operates when power is lost or to start over for any other reason, such as a console pushbutton request. Block 200 clears away all traces of the past; any history of the trains being in any of the track circuits, status of switches and the like is just erased, and the program starts over. The input routine 202 inputs the signals shown in FIG. 7 through TTL inputs and are shown on other diagrams. FIG. 7 shows the names of the functions that are brought in, from pusbuttons, switch positions, and so forth, to provide every desired input from the outside world. They are input once each program cycle so that every routine inside the program is working on the same information.

The output routine 204 is used to provide every desired output as shown in FIG. 8 each program cycle.

The console routine 206 is a well-known routine to process the information from the operator to the computer, and vice versa; it handles all the pushbuttons, all thumbwheel switches, the digital displays, and so forth, and stores in memory whatever information is required for other sections of the program.

The ETC routine 208 takes the track circuit inputs that were input by a previous routine and compares the values against previous values for the same track circuits respectively to see if any changes have occurred. It builds up a series of tables, a past value table, a change table, a went-to-one table, and a went-to-zero table. The routine 208 takes the input and exclusive ORS that value with the past value for the same track circuit to determine a change of state. There is a need to know which direction that change of state was, so ANDing each change of state with the present value, establishes that it went to one which means the track circuit just became occupied, and is stored in the went-to-one table. There is a need to know when the bits disappear so the routine 208 AND's the changes with the past values, this results in the bits which just went to one. The table handling routines in the routine 208 do the same thing for track circuits, switch positions, gate indications, and pushbuttons. The alarm routine 210 uses information from the tracking program. For example, if a train is late getting to a station, the program needs to know which train it was. That information is provided by the tracking program. The alarm program 210 provides an alarm when switches don't move in time, gates don't clear in time, doors don't open in time, trains don't leave the station on time, trains don't get to a station on time, on trains run through a station. The tracking program comprises the direction routine 212 and the tracking routine 214. The next 16 blocks on this flowchart are the station program 220, which includes a route available subroutine 216 and a route select subroutine 218. There are 12 real stations and four pseudostations. A pseudo station is a place where a train stops; does everything it would in a regular station, except open its doors. The program doesn't know the difference.

The routing disclosure covered by the above cross-referenced patent application is primarily associated with the stations logic programs, where all the routing is initiated. In the block diagram of FIG. 9 each of the station programs 220 checks to see if there is a route available and to select that route if it is available. Each of the stations in the routing disclosure has three separate programs; one of them is the station entry logic where all processing necessary to get a train into a station is covered. It is complete when a train runs through the station or when the train doors open. The second set of programs associated with the station is the in-station logic, which involves the route selection, dwell time, headway times, and so forth and is completed when the route to the next station is selected. The last set of stations programs is for station exit logic, where everything is done to check the train out of a station, such as closing the doors and sending information to the next station ahead that the train is coming, sending information that the train has started, and the train number. The train number is derived from the tracking program. At the time the station routine is complete, any route that is required and is requested is stored in memory. Following the station program 220 is the route setup routine 222 which is a software interlocking request program. It requests that any of the routes selected in the previous 16 station programs be set up by interlocking. It does this by requesting switch positions, monitoring the switch indications until all switches are in position, and then requesting gates and locking out all opposing routes. The route setup routine 222 is explained in more detail in the above-referenced routing disclosure.

Next is the route cancel routine 224, which cancels a route when a train takes the route. The route is then canceled, track circuit by track circuit, as the train goes through, to provide a more or less equivalent operation to the well-known sectional release in the prior art hardware interlocking apparatus. The alarm logging 226 and report generation 228 are strictly the logging in memory of any alarm condition or operator action. This information is stored until a report is generated once a day such as at midnight. Alarms are generated by the false occupancies and the dropouts which are detected by the tracking program. The program then goes back and performs another repeat of the illustrated subroutines and continuously goes around the cycle.

Figure 10:
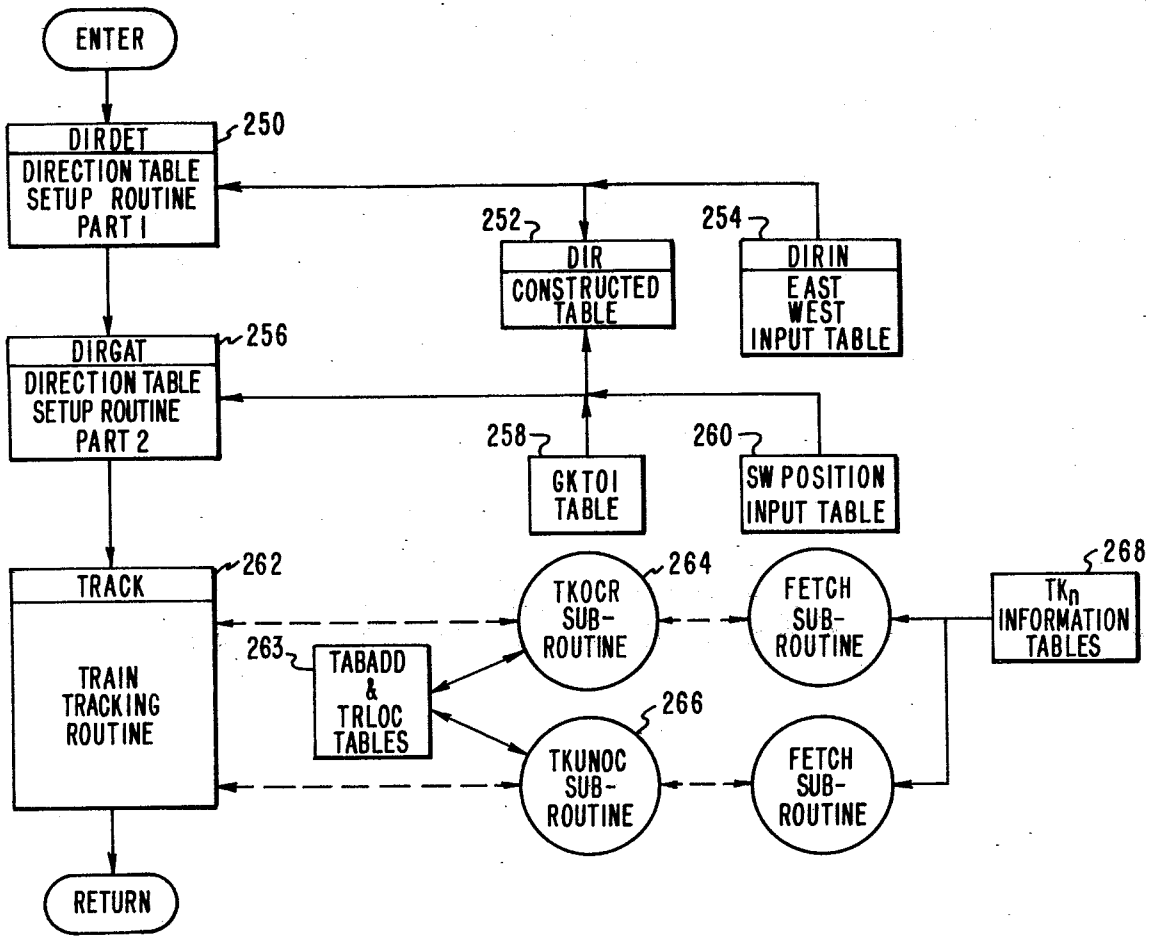
FIG. 10 shows the train tracking program routines and subroutines of the present invention.

FIG. 10 shows the train tracking program overall block diagram, including the flow through the program, routine by routine, the subroutines that are called where necessary, and the tables that are used. The direction routine 212 and the tracking routine 214 shown in FIG. 9 comprise the train tracking program shown in FIG. 10. It is called by the control program shown in FIG. 9 once a cycle. The first routine 250 is direction determining from direction inputs. The interlocking subsystem 114 shown in FIG. 4 furnishes directional input information to the computer only for certain track circuits of the system at certain times, and the train tracking requires that the direction information is known for all track circuits at all times. So the DIRDET routine 250 inputs the information direction bits 254. Every time they change from a zero to a one, which means interlocking now has a direction in effect over an area of track, the new information is stored in the software table 252 called DIR, for direction, and each of these bits remains until another change occurs. In the DIR table 252, a zero is east and a one is west. Interlocking provides the direction inputs by sections of track circuits. The tracking program shown in FIG. 9 requires that a direction bit be provided for each individual track circuit, and the DIR table 252 is constructed to provide this information by these two routines. The DIRIN table 254 gets its status from interlocking. Interlocking only maintains a direction input for a short period of time, while a route is set up, but when the train starts to take this route the direction inputs disappear. The tracking program has to have this information for a longer period of time, so the constructed table 252 remembers it. The DIRGAT routine 256 is the direction table setup based on gate indications. In some sections of this system, there are no input bits from interlocking to give a direction, so the only information available is the fact that a gate cleared. When one of these gates clears, the train is allowed to proceed from that point all the way up to the next gate. DIR bits are set for all of the track circuits involved between the signal gate that cleared and the next signal gate. As an example, when signal gate A clears, the associated bits in the DIR table are set, either to zero or one depending on whether the signals face east or west. If the route is over a switch, a different set of track circuits are involved, so a part of the program follows whatever path it is going to take through the switch, and sets the direction table bits accordingly. The direction determining routine DIRDET has two tables that are involved with this routine, the direction input bits table 254 contains two words, one for the east direction and one for the west direction. And a bit means that the associated section of track is going in that direction. The DIR table 252 which is a constructed direction table, has the direction bits stored in the constructed table as required. The DIRGAT routine 256 uses three tables; it constructs the DIR table 252 by using the gate indication went-to-one table 258, which means that the gate cleared, and the switch position input table 260 which is used to determine which path across a switch is to be used. The last routine 262 is the train tracking routine, which is a bookkeeping routine. Each program cycle it checks every track circuit to see if its status has changed by becoming occupied or unoccupied. One subroutine 264 is called when the track circuit becomes occupied, and one subroutine 266 is called when it becomes unoccupied.

The train tracking routine 262 calls two subroutines, the track became occupied subroutine 264 and the track became unoccupied subroutine 266. When the track circuit becomes occupied, there is an information table 268 used by a subroutine called Fetch which fetches a bit of information out of memory into the computer. The second subroutine 266 is executed each time a track circuit becomes unoccupied, using the same information table 268 and the same Fetch subroutine. The occupied subroutine 264 moves the train number forward as a new track circuit becomes occupied or it sets an alarm in case of a false occupancy when a track circuit becomes occupied and doesn't have the right boundary sequence condition, a 0110 sequence is desired at every boundary. If that boundary sequence is not correct, then a false occupancy is sensed and an alarm is generated and printed. The central control computer cannot stop a train, but it can hold the train and that's what happens when a false occupancy is established. The routing program described in the cross-referenced patent application, will route a train around a false occupancy track circuit, if there's a path available, and if not, the routing program holds the train in the station. The unoccupied routine cancels the train number as the track circuit becomes unoccupied. It checks the same sequence 0110 boundary condition to establish if a dropout has occurred. If it has, an alarm is generated and printed. The routing program, previously mentioned, will not route through a track circuit having an established dropout condition.

The interlocking subsystem 114 is a well-known apparatus that has been in operation for many years for rail transit systems. The function of interlocking is to prevent a train accident. The interlocking subsystem 114 is failsafe in operation and is constructed using failsafe relay logic. When a track circuit becomes occupied, a certain series of relays operates to block out another train from entering that track circuit. A failsafe signal transmitter and receiver operates with each track circuit to provide occupancy information which goes into the relay interlocking and is processed there. The direction signal information results to indicate what direction the train is going over an area of track. The direction information is generated from interlocking based on the gate request, checking the occupancy of every track circuit in that area; checking opposing routes and switch positions, and so forth. If everything agrees, the gate clears, and the direction of traffic is set up, which direction of traffic is used to lock out opposing train moves. The track system shown in FIGS. 3A, 3B and 3C has about 50 track circuits, and about 30 of them are covered by direction input bits as shown in FIGS. 3A, 3B and 3C. This specific version of interlocking has been in use for several years at the Sao Paulo switching yard in Sao Paulo, Brazil.

Figure 11A:
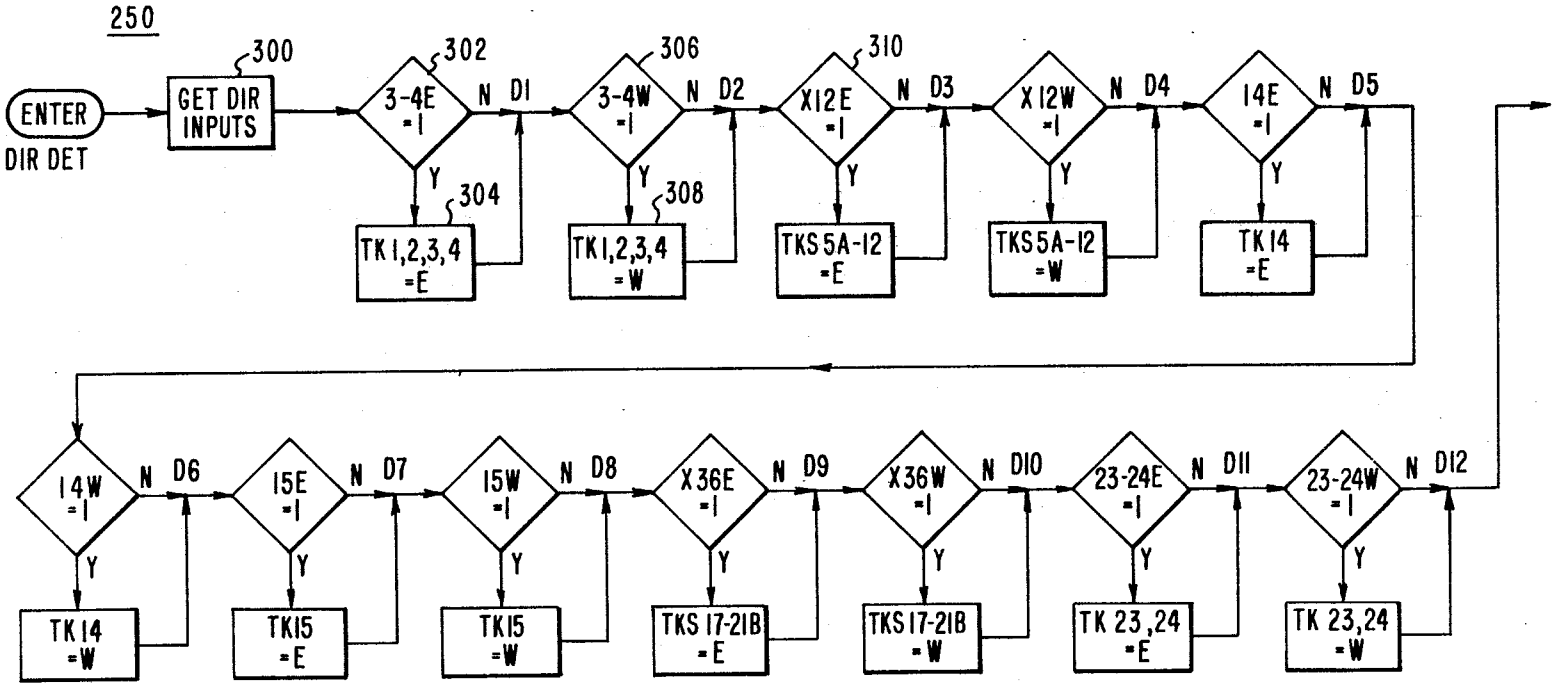
FIGS. 11A and 11B show the DIRDET routine.
Figure 11B:
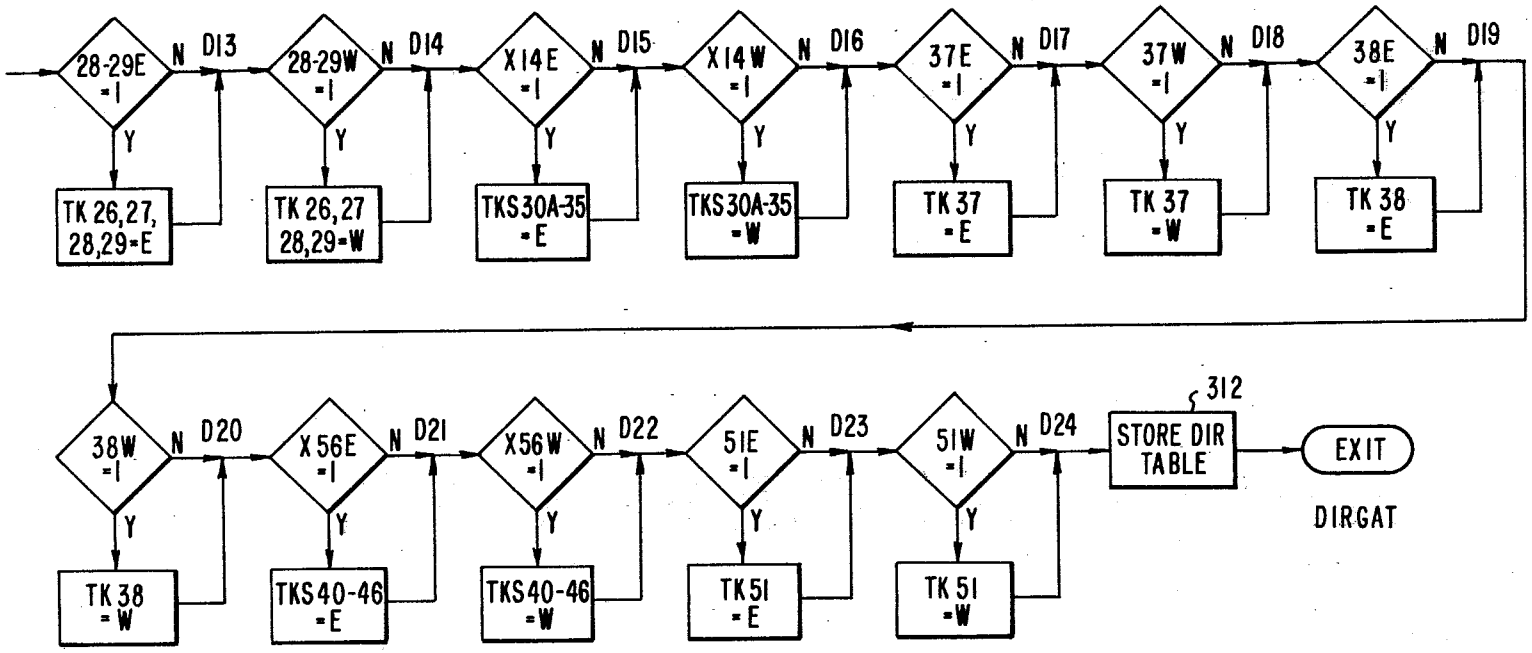

FIGS. 11A and 11B show the DIRDET routine 250 shown in FIG. 10. This is the first half of the direction table setup, and is used to construct the DIR table 252 from the DIRIN inputs 254 from the interlocking subsystem 114 shown in FIG. 4. In the flowchart in FIGS. 11A and 11B, at step 300 the direction inputs are obtained from table 254 which has already been input into the computer by the input routine 202 shown in FIG. 9. This word is information for the north track direction bits with one-half of the word for the east train movement and one-half of the word for the west train movement. The routine first checks the east bit and then the west bit for one area, and then the east bit and the west bit for the next area and so forth. The decision step 302 determines if the direction bit for 3–4 east area is equal to one; this is the direction input bit obtained from interlocking and includes the top half of the switch crossovers 100 and 102.

The decision block 302 asks is 3–4 east equal to one, which means is the directional area 3–4E arrow in east direction on. If the answer is yes, in the DIR table at step 304 the bits for track circuits 1, 2, 3 and 4 are set equal to zero, because the train is moving east. At block 306, a check is made for another bit in that same word to ask in area 3–4, is the train going west? If the answer is yes, at block 308, track circuits 1, 2, 3 and 4 are set equal to one, which means the train is going west. At block 310 a check is made to ask, is the input bit for interlocking area X12 east equal to one? If the answer is yes, in the DIR table track circuits 5A through 12 are set equal to zero, since the train is moving east. The X in front 12E means between, and includes track circuits 5A, 5B, 6, 7, 8, 9, 10 and 11 and 12. This same procedure is carried out for 24 specific interlocking area input bits. If the bit associated with an east direction is one, the associated track circuits direction bits in the DIR table are set to zero. If the bit associated with the west input bit is one, the associated track circuits direction bits are set to one. The last thing done in the routine at block 312 is to store this information in the constructed direction table 252 shown in FIG. 10. At this point in time approximately half of the track circuits have been taken care of with a direction established over them. The directions in the DIR table 252 will then stay there until a input direction bit goes to the opposite state. When the input bit goes away, no change is made in the table 252.

For example, at block 302 a check is made to see if the 3–4 east bit is a one, which happens when the east direction is set up. As soon as a train moves through this route, that bit is going to go to zero, but the DIRDET program routine doesn't do anything, and no check is made to see if that bit goes to zero. The only way that bit is changed is in block 306 where a check is made to see if west is equal to one, which means that interlocking has established the west direction. If it is a one at block 306, at block 308 a one is put in all of those track circuits in table 252. Again, when the train takes that westbound route and the interlocking direction signal goes to zero, these bits are not changed until the opposite direction bit becomes a one. That is how the direction bits are remembered over a period of minutes or maybe even hours for program operation purposes.

Figure 12A:
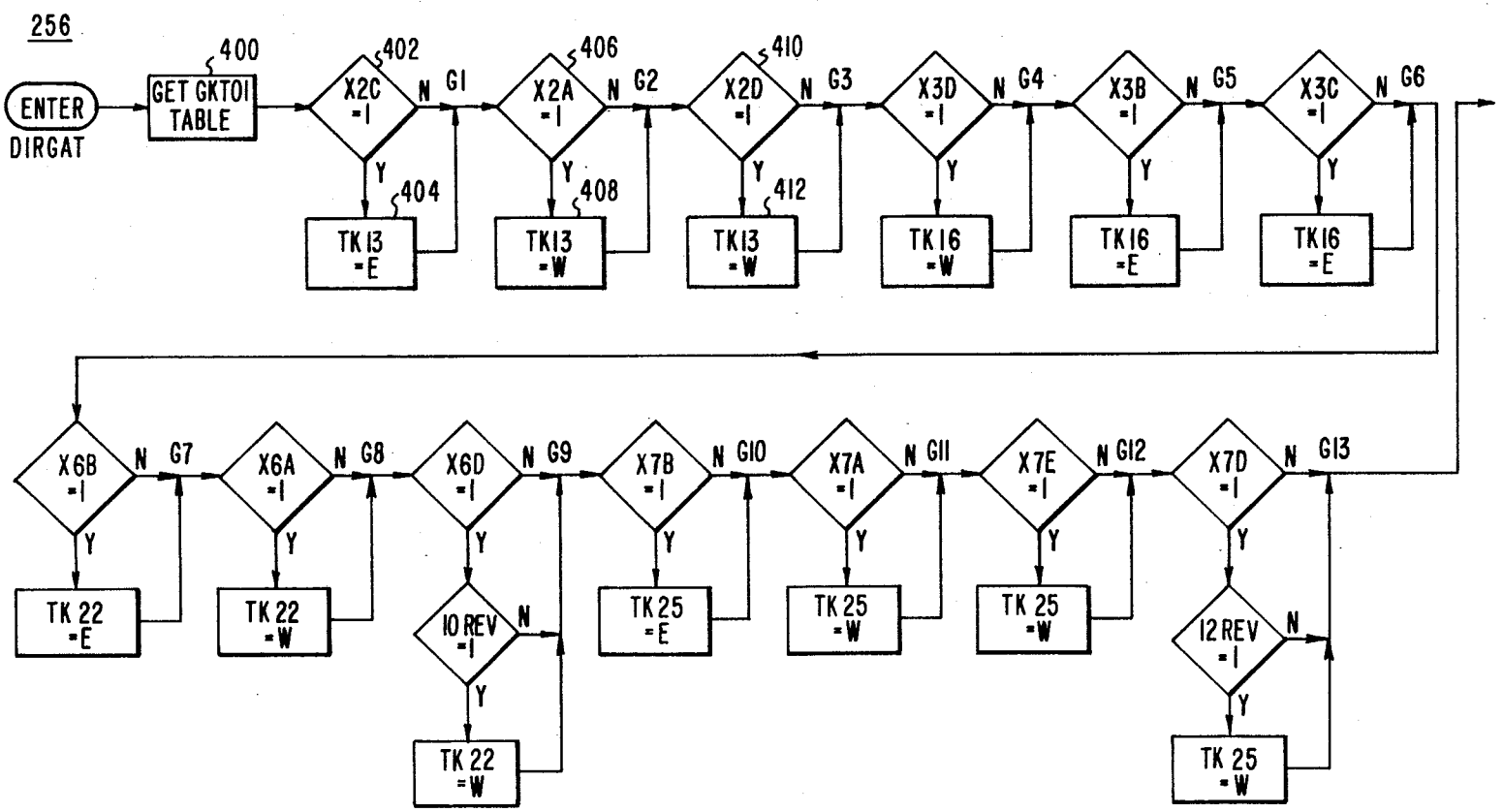
FIGS. 12A and 12B show the DIRGAT routine.
Figure 12B:
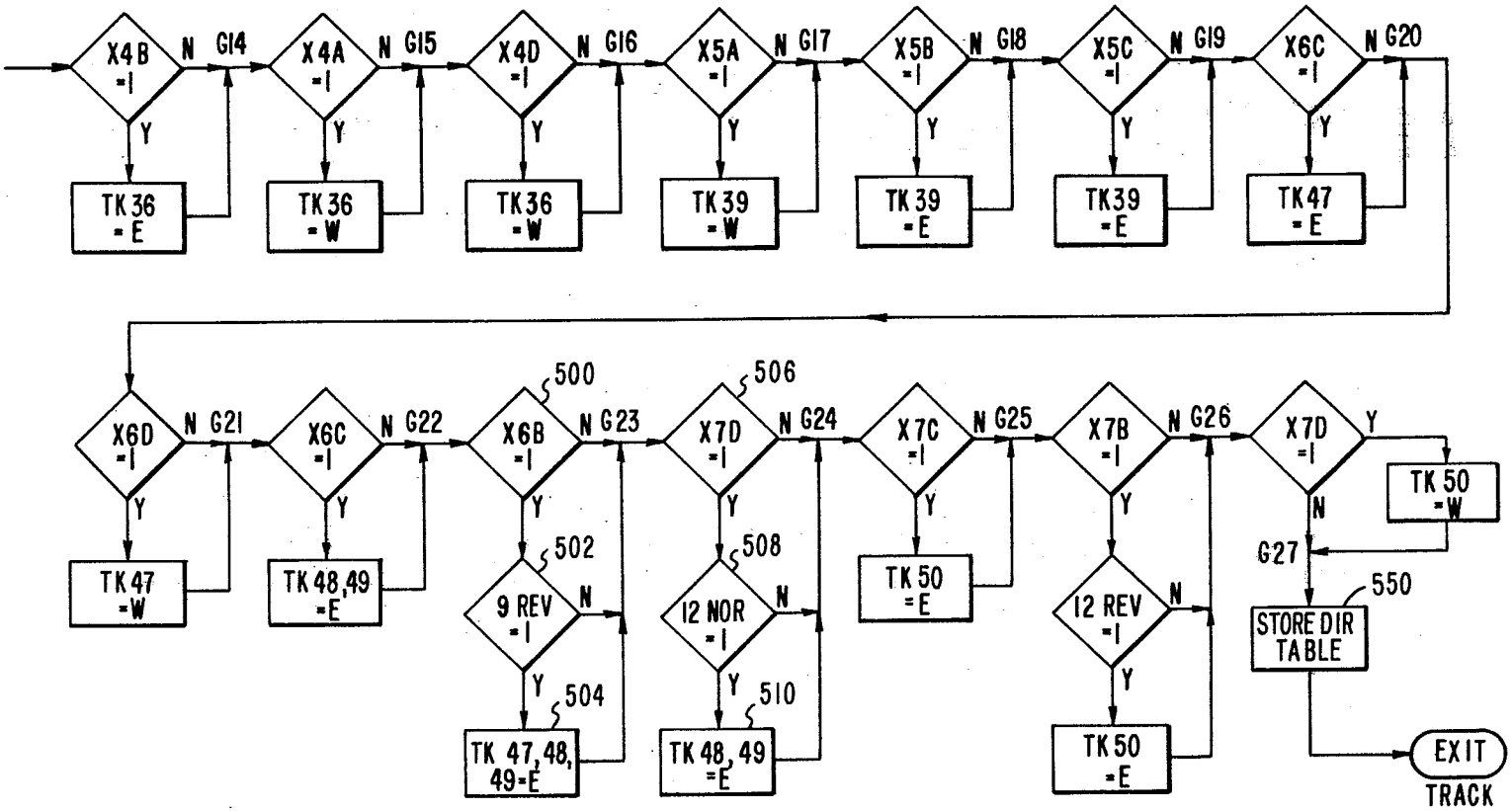

FIGS. 12A and 12B show the second portion of the direction table setup routine called DIRGAT, and this is direction indication determined by gates. This routine uses the GKT01 table 258, which means the gate indication went to one and the table contains a one bit for each gate that just cleared this program cycle. At block 400 get the first word out of the GKT01 table 258, the gate went to 1 table which was constructed earlier. When a gate clears, this by definition establishes the direction of traffic, and a train can go in the direction of the gate, up to the next gate. This program is based on the clearing of a gate, knowing what direction the train is going and if there is a switch involved. For every track circuit in the area covered the bit is set to zero when the train is going east, and set to one when the train is going west. At block 402 is gate X2C clear or equal to one. X2C means interlocking 2, gate C. If the answer is yes, go to block 404 and set the track circuit 13 direction bit equal to zero, which is east; because that signal faces east. Block No. 406 checks to see if signal X2A is equal to one, and if the answer is yes, the train is going west. At block 408 set the track circuit 13 direction bit to one which is west. Block 410 asks is X2D equal to one. If the answer is yes, block 412 sets said track circuit 13 equal to west. The program goes through this entire flowchart using the same principle. There is one extra set of special cases in FIG. 12B at block 500, a switch position is required to be interrogated before it can be established which direction the train is going and which track circuits it should take. At block 500 it asks does X6B equal one, and if the answer is yes, the program goes to block 502. A switch is in this block and there is a need to know which direction the train is going. Block 502 asks if switch 9 is in reverse, and if the answer is yes, at block 504 the track circuits 47, 48 and 49 are set to zero because the train is going east. In block 502 if switch 9 had been normal, the program goes to block 506. At block 506, a determination is made X7D equal to one, and if the answer is yes, at block 508 a check is made to see if switch No. 12 is normal, and if the answer is yes, block 510 sets track circuits 48 and 49 equal to east. The same process is continued until the program gets to the end at block 550, where there is stored in the table DIR the bits that have been determined.

Figure 13:
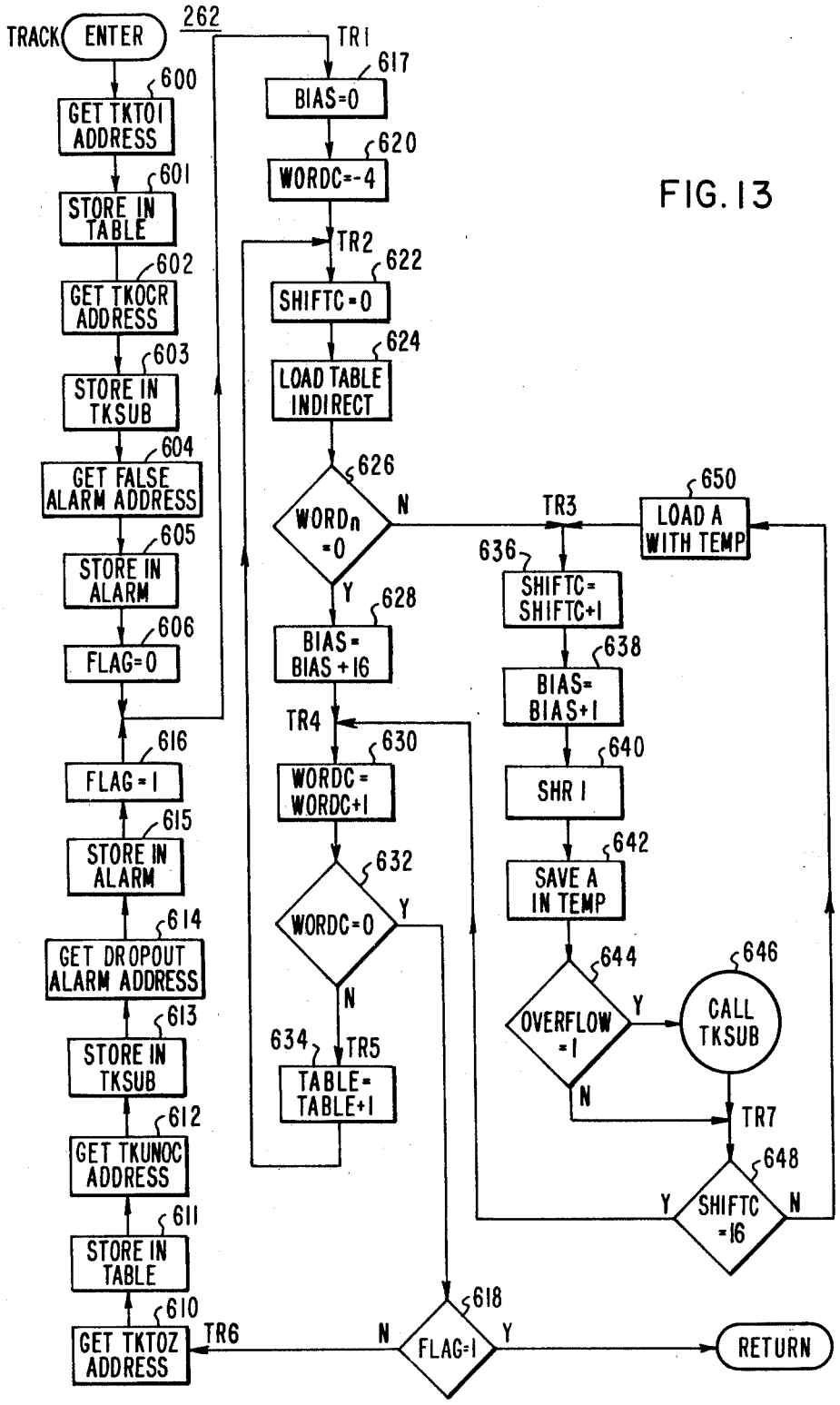
FIG. 13 shows the vehicle train tracking routine.

FIG. 13 shows the train-tracking routine 262 of FIG. 10 and 214 of FIG. 9. It is a bookkeeping routine for the subroutines which do the train tracking. This program routine 262 is entered once a cycle as shown in FIG. 9, right after the direction table setup routine 212 is complete. The train tracking routine 262 shown in FIG. 10 is a bookkeeping routine that checks every track circuit, every cycle, to determine if it changed state. This same routine 262 is shown by the flowchart of FIG. 13. The blocks from 600 through 606 are for the case where the track circuit became occupied, and the blocks 610 through 616 are for the case where the track circuit became unoccupied. Block 600 gets the address of table 258 for the track circuit went-to-one table. Its counterpart block 610 gets the address of table 254 for the track circuit went-to-zero table. In blocks 601 and 611 that address is stored in a memory location called TABLE. Blocks 602 and 612 gets the respective subroutine addresses, with block 602 being the address for the became occupied routine and block 612 being the address for the became unoccupied routine. Blocks 603 and 613 store that subroutine address in a memory location called TKSUB, which means track subroutine. Block 604 gets the false alarm table address and block 614 gets the address for the dropout alarm, which are the particular alarm cases for the respective paths through the program. Blocks 605 and 615 store the alarm table address in ALARM. Block 606 sets the memory location called FLAG equal to zero, which FLAG is used to tell the program is finished or not. The first time through the routine, FLAG is set equal to zero. At block 618, after each pass through this routine a check is made of this location to see if the flag is equal to one and if the answer is yes the program is finished and if the answer is no, the first time through it will be a "no" because it is set to zero at block 606, the program goes to block 610 and goes through the routine again for the unoccupied condition. At block 616 the flag is set equal to one, and the routine goes through one more time to get to the final test in block 618 and be finished. The reason for these two front ends, with blocks 600 to 606 and blocks 610 to 616, is to save memory locations. At block 617, BIAS is set to zero, BIAS is nothing more than a bit counter. BIAS is a count of the bits, there are 64 bits that have to be checked because there are 64 track circuits. So BIAS goes from zero to 63. Block 620 sets word counter WORDC equal to minus 4, since the particular computer utilized works better counting up than it does down. At block 622 the shift counter is set equal to zero, which shift counter is strictly a counter on the number of bits in a word, and since there are four words, this means that four different times the shift counter will run from zero through 15. Block 624 loads word being processed indirectly from memory location TABLE. The first pass through this loop gets the first word out of the track circuit went-to-one table, and block 626 checks if the word is equal to zero. If there are no bits set in the word, there is no need to run it through a shift register, so a check is made to see if the whole word is zero, and if the answer is yes, go to block 628 and add 16 bits to the bias counter. Block 630 sets the word counter to one more than it was. Block 632 checks the word counter to see if it is zero; since it was set to minus 4 in block 620, it cannot be zero until the fourth pass, so the program goes to block 634 and adds one to the table address counter, and then goes back to block 622 again for the next pass. The shift counter is set equal to zero at block 622. Block 624 loads the new word. Block 624 checks if the word is zero, this time assume it is not zero, with one or more track circuit bits in that word changed. Block 636 increments the shift counter by 1. Block 638 increments the bias by 1. Block 640 actually shifts the word. Block 642 saves the contents of this word because this is a partial operation and the program is not finished with the word so it is saved in a location called TEMP. Block 644 checks for the overflow that would result at block 640 if the bit was a one. If there was an overflow, the bit was a one and the program will operate on it, if there was no overflow the next bit is checked. In the block 644 if the bit was equal to one, the program calls TKSUB, which is a subroutine 646 that does all the handling of the information required when a track circuit just became occupied. When TKSUB finished its work, it comes back to location TR7 on the flowchart and goes to block 648, which checks if the shift counter is equal to 16. If the shift counter is equal to 16, that word is finished and the program goes to block 630 to increment the word counter, since the word is finished. At block 632 a check is made to see if WORDC is zero, if not the table address is incremented at block 634. At block 622 the shift counter is set equal to zero, and a new word is processed. The other path at block 648 checks the shift counter to see if it equals 16. If it is not equal to 16, go to block 650 and the word or the remnants of that word stored previously in TEMP is reloaded. Block 636 increments the shift counter, block 638 increments the bias, block 640 shifts right again and continues the process to go through the loop 16 times, then the program goes to block 630 and increments the word counter. It goes through that path 4 times until all 16 bits are checked in each of the 4 words. At block 632 when the word count goes to zero, the program is finished with the table, and it goes to block 618 and checks FLAG. If FLAG equals zero, the program has not checked the track circuit became unoccupied path, so it goes through the initialization blocks 610 to 616, and then through the program as previously described to cover all 64 bits for the became unoccupied case.

Figure 14:
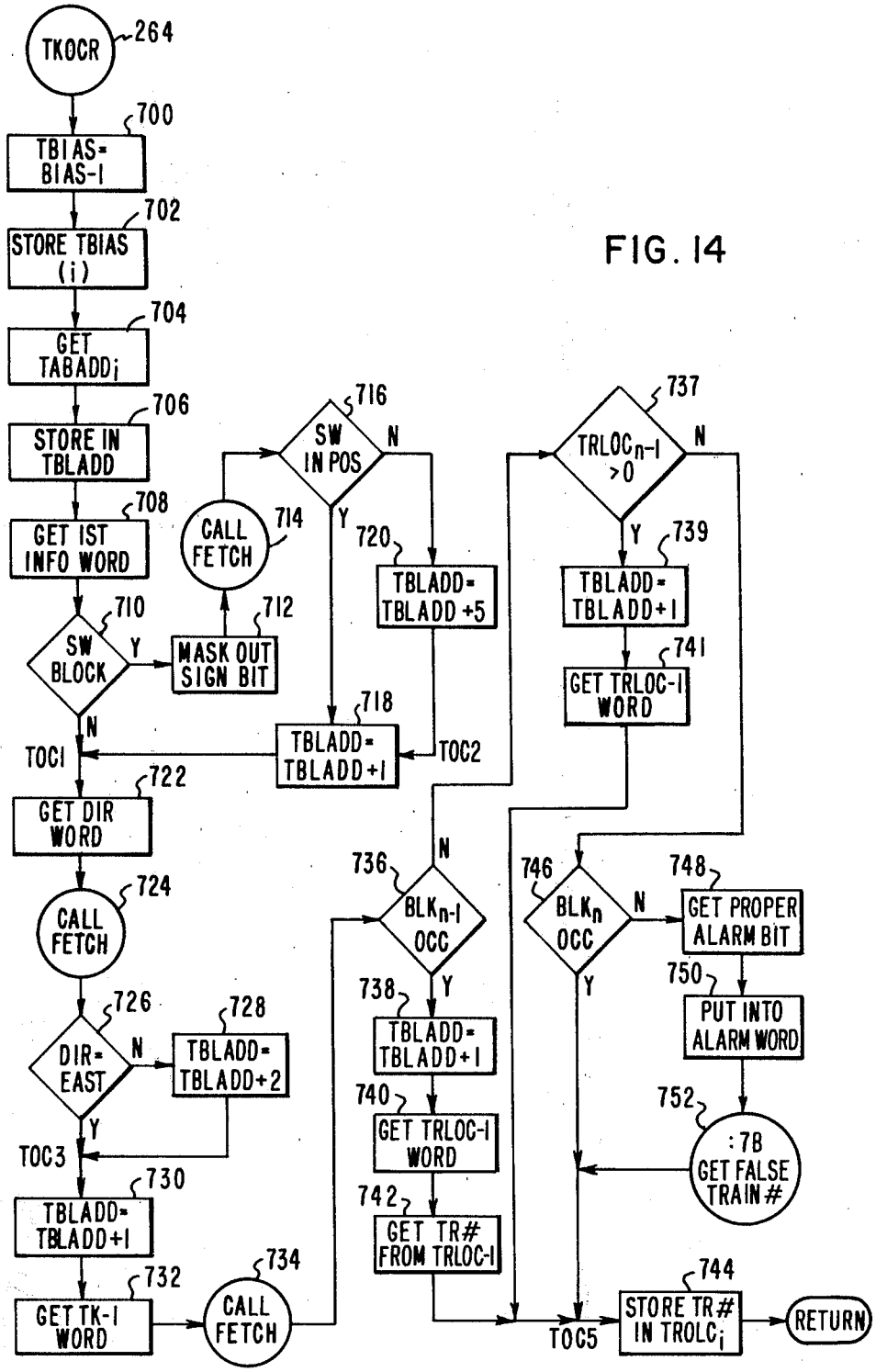
FIG. 14 shows the track circuit became occupied subroutine.

FIG. 14 shows the track circuit became occupied subroutine 264 in FIG. 10, which does the work of tracking a train when a track circuit occupancy is detected. This is determined by the TKT01 table 904 shown in FIG. 16. Primarily, it works with $TK_i$ tables 900 and 902, which are the track circuit information tables including the direction location, whether a switch is within the track circuit, the previous track circuit or the next track circuit, and the specific TRL0C table location for the train number associated with it.

At block 700, a bias counter is built up in the track routine to show the location in the table corresponding to the position of the input bit in its table. At block 700, one is subtracted from the table bias to go back one position in the table. At block 702 the table bias is stored for future reference. At block 704, the bias is added to the address for the table TABADD of FIG. 16. This position in the TABADD table contains the $TK_i$ table address that is desired, which is stored at block 706. Block 708 gets the first word in the $TK_i$ table. Block 710 checks to see if this track circuit has a switch in it. If the first word has a negative bit, there is a switch in the track circuit. In block 710 check the negative bit, if ON, it is a switch block so go to block 712, where the sign bit is erased, since the rest of information in the word is used for other things; it contains the address and bit position of the direction table. At block 714 call the Fetch subroutine, with the word in the accumulator. The right hand digit is the bit position in a word and the other digits tell the location in memory where the information is located. Upon return to the main program if the A register contains zero, the bit was not present and if the A register is not zero, the bit was present. Block 716 checks if the switch is in the correct position. If the bit was one, the answer is yes go to block 720. Both of these locations adjust TBLADD to address the proper word in the TK table. Block 720 takes the table address and adds 5 to it, to use the direction word in the bottom half of the example table. Block 718 adds 1 to the table to go to the direction word in the top half of the table. Block 722 gets the direction word for the identified track circuit to see what direction the train is going which is shown by either the second or sixth word in the table depending upon the switch position. At block 724, call the Fetch subroutine which returns at block 726, with the direction bit in the A register. Is the direction east, is the A register zero, if not go to block 728 and add two more locations to the table to bypass the two words associated with the east direction. If east, go to block 730 and use the next location in the table. At block 732 get TK-1 word, which is the previous track circuit to the one the train is now in to see if the previous track circuit was occupied. Block 734 calls Fetch and it comes back with a one if occupied and a zero if not occupied. At block 736 check to see if block n-1 was occupied. If it was, this is the normal case where the present block becomes occupied and the previous block was occupied. At block 738, increase the table address by one and block 740 gets the TRL0C-1word which is the TRL0C table location for the previous track circuit. Block 742 gets the train number from previous track circuit. Block 744 stores the train number in the present track circuit TRL0C table.

Going back to 736, if the previous track circuit shows no occupancy, due to contact bounce, poor track shunting, a false occupancy or hardware failure, a software filter operation is provided by making a check at step 737 to see if the TRL0C table for the previous track circuit has a train number. If yes, steps 739 and 741 get that number and store it in the $TRL0C_i$ location. The other case is the false occupancy, and if the previous circuit was not occupied, it means there is a problem because a train showed up in a track circuit without having come from anywhere, which is the definition of a false train. So at block 746 check the track circuit the train is in now to see if it was already occupied, because the most common case of a dropout is when the train is already in the circuit. A check is made to see if the train was already there. If the answer is yes, no alarm is generated and it is assumed to be okay, so go to block 744 and store the train number. If the answer is no, then go to block 748 to get the track circuit alarm bit, at block 750 this bit is stored in the false alarm table to provide a bit in that table which corresponds to the alarm bit in the track circuit. At block 752 get the false train number. When a false occupancy occurs there is assigned to it a false train number, and then if by any chance it started to move, which would be the case if a vehicle were dropped on the track from a helicopter which a tracking system is supposed to be able to handle, it will actually start tracking this train and carry the false number with it around the system. Block 752 gets the false train number that was previously assigned, and subtracts one from it and uses the next lower number. There could be several unidentified trains running around the track. A legitimate case for this would be if power was off then came on, every train would appear as a false train because it had just instantly appeared to the tracking system. When the power is off, the trains on the track will move, and when the power comes back it will result in some false occupancies and some dropouts. The trains run off a different power system than the tracking system, so when one goes down the other may not and vice versa, and when the tracking system power comes on, many of the trains on the track will be unidentified. The false train numbers stay with a false train until the operator changes the number. Once a number is assigned to a train, either through a false train number or from the operator, the tracking system will track the train as long as it is on the system. One of the operator's jobs as soon as the computer stops and then comes back on, is to identify all those trains through the switches on his console. We can have 6 trains running around the loop, one on each bypass, one stored in the west end and two at the east end. We could have 11 trains on the system at once. A table of train numbers that are on the system is provided and each one of them may have four cars. It is a static table that doesn't change. When the operator enters a train, for example train 10, with cars 1, 2, 3, it goes in this table. When he enters train 11, with cars 4 and 5, it goes into the table. When a car number comes in with an alarm the car number is be used to see which train it's located on. That number is run through the TRLOC table to find out where the train is located. For this purpose, the determination can start with the train number and end up with car number or start with the car number and end up with the train number, and both cases would end up with the location.

Figure 15:
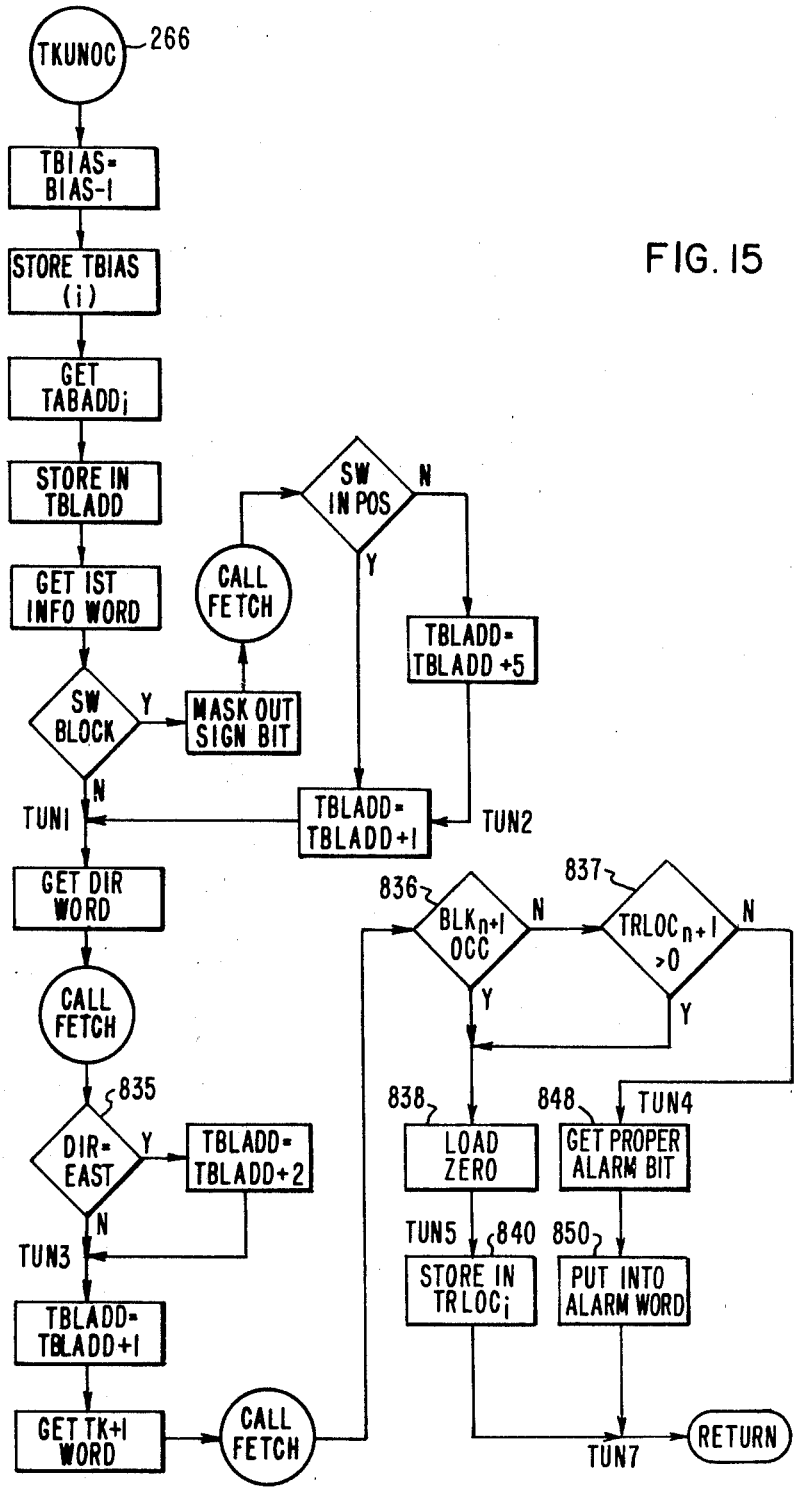
FIG. 15 shows the track circuit became unoccupied subroutine.

In FIG. 15 there is shown the track circuit became unoccupied subroutine 266 in FIG. 10. Up to and including block 736, the routines 264 and 266 are identical with one exception—everything in backwards. As an example, at block 726 a check is made in the occupied routine 264 to see if the direction is east. If west, a 2-location drop is made in the table. In the unoccupied routine 266, at block 835 a check is made to see if the direction is east and when the answer is yes a drop is made of two words in the table because you look in the opposite direction for a reaction. There is no need to go through this routine 266 because in relation to routine 264 the paths are the same. The alarm case for the occupied routine 264 was a false occupancy, while the alarm case for the became unoccupied routine 266 is a dropout. A track circuit become unoccupied to get into this routine 266, and block 835 checks if the next signal block occupied. If this signal block just became unoccupied and the train is going east, there should be a train in that next signal block because that's the only place the train could have gone so the next block is checked. At step 836 a check is made to see if that next block is occupied. If the answer is yes, there is no problem, so the program goes to step 838 and erases the train number that was in this signal block because it became unoccupied and the program is finished. If the answer at step 836 is no, at step 837 a check is made to see if the TRLOC table for the next block contains a train number. If it does at step 838 and 840, the TRLOC table location is set to zero. Otherwise, at step 848 the program goes through the alarm type sequence that was gone through before using the DROP table instead of the FALSE table. The unoccupied routine 266 is provided to remove train numbers for a given track circuit when a train leaves, to clear tracking in relation to an unoccupied track circuit signal block. The dropout situation occurs where a track circuit becomes unoccupied and in the track circuit ahead there is no train. The train disappears from one track circuit and doesn't appear in the next track circuit.

FIGS. 16A and 16B show the information tables used with the program routines of FIGS. 11 to 15. In FIG. 16A there is shown a typical track circuit table 900, which is for non-switch track circuit block 2 shown in FIG. 3A, and a typical track circuit table 902 for switch track circuit block 3. There is one table for each track circuit, with the switch block table 902 having eleven locations and the non-switch block table 900 having five locations. The table has the address and bit location of the previous track circuits for each direction of travel and for each switch position and the memory location for the train number associated with that track circuit. In table 900, the first word gives the word and bit location in the DIR table constructed previously for the bit associated with track circuit 2, the second word, used if the train is going east is the location in memory to find the previous track circuit indication. The third word is a TRLOC table address that contains the train number in that given track circuit, the fourthh word is the location in memory of the previous track circuit indication when going west, and the fifth word is the TRLOC table address that contains the train number for the track circuit.

For example, if a train is in track circuit 1 and moving east, it next goes into track circuit 2 and 2T will become occupied. The TKOCR program shown in FIG. 14 sees 2T become occupied, and the program then uses table 900 to find out what direction the train is going and to see if there was a train in the track circuit behind it by looking in the 1T track circuit location of the TRLOC table. If there is a number in 1T track circuit location, the program knows the train is legitimate and takes the train number in 1T and puts it in 2T, now the train number is in two locations in the TRLOC table. As the train keeps moving east, track circuit 1 will become unoccupied, and the TKUNOC program shown in FIG. 15 will then go through the table 900 again to find out which direction the train is going. It will look at track circuit 2 to see is there a train number there. If there is, this is a legitimate move, since the train moved from 1 into track circuit 2, and the program will delete the train number in 1. This operation follows the movement of the train with TRLOC having the train number that is in any portion of any track circuit in the system. Table 263 includes TABADD which is an address table for the TRLOC table. The particular Computer Automation LS12 computer 152 shown in FIG. 5 and here utilized will not permit direct addressing outside of Page 0, so tables are set up to tell the program where other tables are located.

TABADD contains the addresses of the TRLOC table 263. Table 904 is TKT01, which means the track circuit went to one, as it is required to know whenever a track circuit becomes occupied by a train. Table 906 TKTOZ is track circuit WENT TO ZERO. These two tables 904 and 906 are constructed in ETC program 208 shown in FIG. 9, by working table handler section that reads the input and exclusive OR's it with the past value of that same input, any resulting bit means that bit has changed state. For the table 904, the present input is ANDED with the changes to get the WENT TO ONE table 904. For the table 906, the changes are ANDED with the past value to get the WENT TO ZERO table 906. This routine includes several tables that go through this same process, and each of those includes five tables i.e. INPUT, PAST VALUE, CHANGE, WENT TO ONE and WENT TO ZERO.

Tables 908 and 910 are associated with alarms, table 908 for false alarms that are detected when an occupancy occurs for a given track circuit and there was no previous occupancy in the track circuits on either side of it, and the table 910 is for dropouts that are detected when an occupancy disappears in a given track circuit with no train occupancy in the track circuits on either side of that given track circuit. These two tables 908 and 910 are constructed in the tracking program. Every time a false occupancy bit is detected, it is set in the table in the same relative position as the track circuit input bit. All four of these tables 904, 906, 908 and 910 have the same format, with one bit position associated with each track circuit input bit position. The information from tables 908 and 910 is used by another program to print out an alarm. Tracking is passive and furnishes information after the fact has occurred, for routing or alarm printout.

Table 912 DIRIN contains the direction inputs which are shown on FIG. 3 on the long brackets 3-4E, 3-4W and so forth, these are the input bits associated with certain track circuits as shown in FIG. 3.

Table 914 is GKT01 or the gate indication went-to-one which is established in the ETC routine 208 shown in FIG. 9.

Table 916 contains the switch position inputs, which are input by the input routine 202 and stored, one word for normal position and one word for reverse position for each switch.

The track circuit sequence for boundary conditions that is here determined follows the following sequence of occupancy signals

Figure 17:
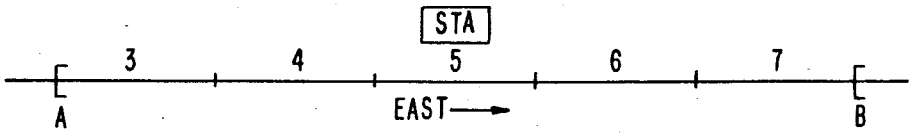
FIG. 17 shows a train tracking operation with a passenger station positioned between two signal gates.

| | |
|---|---|
| 0 | 0 |
| 1 | 0 |
| 1 | 1 |
| 0 | 1 |
| 0 | 0 |

and operates to track the train movement around the track system, with the track circuits as indicated in FIG. 3. By forcing this desired sequence of track circuit occupancies, this permits determining if a train is going in the right direction or in the wrong direction. As an end result this operation determines dropouts, false occupancies and permits providing an alarm for late trains. The well-known interlocking gives an occupancy indication in every track circuit, but this information might be false and only what interlocking thinks is the train occupancy situation. The present tracking control uses these indicated occupancies, but in addition determines if this information is real or not by making an additional check regarding dropouts and false occupancies. The individual track circuit directions are determined by signals from interlocking or by gates clearing or by turnbacks. The prior art tracking systems always had available a direction signal for every track circuit and did not have to develop these direction signals. The prior art interlocking operation only needs direction signals when track circuit becomes occupied, whereas for the present tracking system the direction signal is also needed when track circuit becomes unoccupied and by the time this information is needed interlocking has lost this signal. So the present system has added a memory storage for direction signals furnished by interlocking, and when the direction signal is not furnished, it has to be determined by turnback and gate clearing operations. The track system shown in FIG. 3 is separated by gate signals at every crossover switch. As shown in FIG. 17, when a gate signal A clears in relation to a train going east, the direction signals in each of track circuits between gate A and the next gate B are set for east, and these direction signals stay until some gate going in opposite direction west clears such that the directions signals for overlapping track circuits then change to go west. In FIG. 17 a station is shown positioned between the gate A and the gate B. When a train is going east and comes to the gate A which clears and sets the direction signals for all track circuits between gate A and going east. When the train arrives at the station and a turn-around reverse is provided, the track circuit direction signals from the station back to the gate A entry are now going west with no gate clearing as such happening.

When the gate A initially went green, in the DIR memory table of constructed direction signals, a zero for going east was placed in track circuits 3, 4, 5, 6 and 7 up to signal gate B. Then as the train arrives at the station and turns around and heads back west, with no gate signal clearing being involved, the east directions for track circuits 3, 4 and 5 are now wrong, and have to be changed to a ONE for going west in the DIR table for each of these track circuits 3, 4 and 5. The track circuits 6 and 7 do not have to be changed in relation to the turnback movement of this train, and will not change until some other action such as a gate clears on the east side of the station to permit a different train to move west through the track sections 6 and 7.

Figure 18:
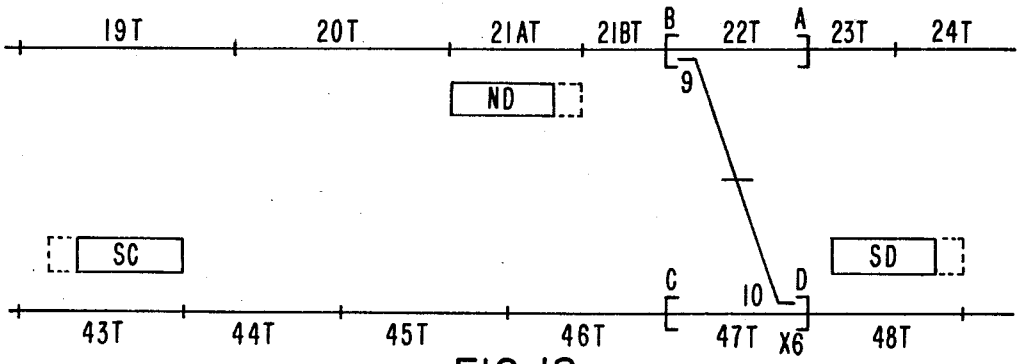
FIG. 18 shows a train tracking operation involving a crossover switch.

FIG. 18 shows an example of the DIR table operation when a crossover switch is involved with the desired train movement. The track circuits 43T, 44T, 45T, 46T, 47T, 48T and 49T are in the south track. When the gate C cleared, the track circuits 47T, 48T and 49T were set to zero for east. When a train moving from station SC on the south track and going east enters station SD in track circuit 50, a turnback is provided in station SD and it is now desired for the train to reverse and go through switch 10 and cross over to the north track and go into station ND. The gate signal D has to clear for a train movement to the west for this to happen. If the train were instead desired to remain on the south track and switch 10 is normal such that the train remains on the south track the program operates to provide ONE direction signals in track circuits 47T, 46T and so forth, and in addition, the track circuit 48T before the gate D is changed to ONE. If the train is desired to move to the north track and the switch 10 is reversed such that the train crosses through switch 10 and switch 9 over to the north track, the program operates to provide ONE direction signals in track circuit 48T ahead of the gate D and the track circuits 22T, 21BT and 21AT into station ND.

In FIG. 1 there is provided a diagrammatic showing of the track system shown in FIG. 3, to illustrate the turnback operations provided for the normal mode 30 operation of the trains moving counterclockwise around the track loop. A turnback is required at the east end of the track system in relation to station SD and a turnback is required at the west end of the track system in relation to station NG. However, for a shuttle operation of a train on the south track, the train might have a turnback at station SG at the west end and a turnback at station SD at the east end and move back and forth on the south track. The operator can select a desired mode of train operation depending upon the track maintenance underway or for off-peak night operation of a train or the like.

GENERAL DESCRIPTION OF INSTRUCTION PROGRAM LISTING

In Appendix A there is included an instruction program listing that has been prepared to control a process operation, such as transit passenger vehicles in accordance with the here disclosed control system and method. The instruction program listing is written in the assembly language of the Computer Automation LSI 2-20 computer system. Many of these computer systems have already been supplied to customers, including customer instruction books and descriptive documentation to explain to persons skilled in this art the operation of the hardware logic and the executive software of this digital computer system. This instruction program listing is included to provide an illustration of one suitable embodiment of the present control system and method that has actually been prepared. This instruction program listing at the present time is a more or less development program and has not been extensively debugged through the course of practical operation of vehicles on a transit system. It is well known by persons skilled in this art that real time process control application programs may contain some bugs or minor errors, and it is within the skill of such persons and takes varying periods of actual operation time to identify and correct the more critical of these bugs.

A person skilled in the art of writing computer instruction program listings, particularly for an invention such as the present transit vehicle control system must generally go through the following determinative steps:

Step One—Study the transit vehicle operation to be controlled, and then establish the desired control system and method concepts.

Step Two—Develop an understanding of the control system logic analysis, regarding both hardware and software.

Step Three—Prepare the system flow charts and/or the more detailed programmer's flow charts.

Step Four—Prepare the actual computer instruction program listings from the programmer's flow charts.

This instruction program listing included in the Appendix was prepared in relation to the programmer's flow charts.

```
PAGE  0001  07/22/80  01.13.47  'TRAIN TRACKING PROGRAM '
MACRO2 (A2) SI= TRK.R   BO=

0002                    *
0003                    *
0004                    *        THIS PROGRAM PERFORMS FOUR FUNCTIONS
0005                    *
0006                    *        1  MOVES TRAIN NUMBERS AROUND WITH OCCS
0007                    *        2. DETECTS FALSE OCCUPANCIES
0008                    *        3  DETECTS DROPOUTS
0009                    *        4. SETS ALARM BITS
0010                    *
0011                    *
0012                    *        THE FOLLOWING ROUTINES/SUBROUTINES ARE USED
0013                    *
0014                    *        FETCH     ISOLATE SPECIFIED BIT SUBROUTINE
0015                    *        TRACK     TRACKING ROUTINE
0016                    *        TKOCR     BECAME OCCUPIED SUBROUTINE
0017                    *        TKUNOC    BECAME UNOCCUPIED SUBROUTINE
0018                    *        :7B       GET FALSE TRAIN #
0019                    *
0020                    *
0021                    *        THE FOLLOWING TABLES ARE USED:
0022                    *
0023                    *        TKT01     WENT TO 1
0024                    *        TKT02     WENT TO 0
0025                    *        DIR       DIRECTION OF TRAVEL BY TRACK CKT
0026                    *        TRLOC     TRAIN LOCATION BY TRACK CIRCUIT
0027                    *        TABADD    ADDRESS TABLE FOR TKN TABLES
0028                    *        TK(N)       TK CKT INFO TABLES
0029                    *        BIT0       BIT TABLE
0030                    *        FALSE     FALSE OCC ALARM TABLE
0031                    *        DROP      DROPOUT ALARM TABLE

0033                    *
0034                    *
0035                    *        TRAIN TRACKING ROUTINE
0036                    *
0037                    *        THIS ROUTINE DETERMINES WHETHER A TRACK
0038                    *        CIRCUIT HAS BECOME OCCUPIED OR UNOCCUPIED
0039                    *        SINCE THE LAST CYCLE.
0040                    *
```

BEST AVAILABLE COPY

```
0041                    *          FOR EACH CHANGE OF STATE A SUBROUTINE
0042                    *          IS USED TO DETERMINE WHAT FUNCTIONS
0043                    *          ARE TO BE PROCESSED.
0044                    *
0045                    *          TKOCR  TK BECAME OCCUPIED
0046                    *          TKUNOC TK BECAME UNOCCUPIED
0047                    *
0048                    *
0049  4C00                       ABS     :4C00
0050                    *
0051                    *
0052  4C00 0800         TRACK    ENT
0053  4C01 B22D 4C2F            LDA     ATKTO1
0054  4C02 9A33 4C36            STA     TABLE     OCC TABLE ADDRESS
0055  4C03 B22D 4C31            LDA     ATKOCR
0056  4C04 9A35 4C3A            STA     TKSUB     OCC SUBROUT ADDRESS
0057  4C05 B22D 4C33            LDA     FALSE     FALSE OCC ALARM ADDRESS
0058  4C06 9A2E 4C35            STA     ALARM
0059  4C07 0110                 ZAR
0060  4C08 9A33 4C3C            STA     FLAG      FIRST PASS FLAG
0061  4C09 0110         TR1     ZAR
0062  4C0A 9A2C 4C37            STA     BIAS      TABADD TABLE BIAS
0063  4C0B B233 4C3F            LDA     MFOUR
0064  4C0C 9A2B 4C38            STA     WORDC     WORD COUNTER
0065  4C0D 0110         TR2     ZAR
0066  4C0E 9A2A 4C39            STA     SHIFTC    SHIFT COUNTER
0067  4C0F B326 4C36            LDA     *TABLE    OCC/UNOCC TABLE POINTER
0068  4C10 3113 4C24            JAN     TR3
0069  4C11 B225 4C37            LDA     BIAS      BIAS + 15
0070  4C12 8A2B 4C3E            ADD     SXTEN
0071  4C13 9A23 4C37            STA     BIAS
0072  4C14 DA23 4C38  TR4       IMS     WORDC
0073  4C15 F203 4C19            JMP     TR5       GET NEXT WORD
0074  4C16 B225 4C3C            LDA     FLAG      FIRST PASS?
0075  4C17 2104 4C1C            JAZ     TR6       YES, SET UP FOR 2ND
0076  4C18 F718 4C00            RTN     TRACK     NO, FINISHED
0077  4C19 DA1C 4C36  TR5       IMS     TABLE
0078  4C1A DA1A 4C35            IMS     ALARM
0079  4C1B F60E 4C0D            JMP     TR2
0080  4C1C B213 4C30  TR6       LDA     ATKTOZ    UNOCC TABLE ADDRESS
0081  4C1D 9A18 4C36            STA     TABLE
0082  4C1E B213 4C32            LDA     ATKUNO    UNOCC SUBROUT ADD
0083  4C1F 9A1A 4C3A            STA     TKSUB

0084  4C20 B213 4C34            LDA     DROP      DROPOUT ALARM ADDRESS
0085  4C21 9A13 4C35            STA     ALARM
0086  4C22 DA19 4C3C            IMS     FLAG      SET FLAG FOR PASS 2
0087  4C23 F61A 4C09            JMP     TR1
0088  4C24 DA14 4C39  TR3       IMS     SHIFTC    INC SHIFT COUNTER
0089  4C25 DA11 4C37            IMS     BIAS      INC ADDRESS POINTER
0090  4C26 13D0                 LRA     1         CHECK BIT
0091  4C27 9A13 4C3B            STA     TEMP      YES, SAVE INFO
0092  4C28 3201 4C2A            JOR     TR7       NOT SET
0093  4C29 FB10 4C3A            CALL    *TKSUB    GO TO SUBROUTINE
0094  4C2A B20E 4C39  TR7       LDA     SHIFTC
0095  4C2B 9212 4C3E            SUB     SXTEN     WORD COMPLETE?
0096  4C2C 2158 4C14            JAZ     TR4       YES
0097  4C2D B20D 4C3B            LDA     TEMP      NO, RELOAD INFO
0098  4C2E F60A 4C24            JMP     TR3       CHECK NEXT BIT
0099                    *
0100                    *
0101                    *
0102  4C2F 5078         ATKTO1 DATA     :5078     OCC TABLE ADDRESS
0103  4C30 507C         ATKTOZ DATA     :507C     UNOCC TABLE ADDRESS
0104  4C31 4C40         ATKOCR DATA     TKOCR     OCC SUBROUT ADDRESS
0105  4C32 4C7F         ATKUNO DATA     TKUNOC    UNOCC SUBR ADDRESS
```

```
0106                        *
0107  4C33 5B74'            FALSE  DATA   5B74    FALSE OCC ALARM TABLE
0108  4C34 5B78             DROP   DATA   5B78    DROPOUT ALARM TABLE
0109  4C35 0000             ALA    DATA   0       TEMP ALARM TABLE ADDRESS
0110  4C36 0000             TABL   DATA   0       POINTER FOR OCC/UNOCC TABLE
0111  4C37 0000             BIAS   DATA   0       POINTER IN ADDTAB TABLE
0112  4C38 0000             WORDC  DATA   0       WORD COUNT
0113  4C39 0000             SHIFTC DATA   0       SHIFT COUNT
0114  4C3A 0000             TKSUB  DATA   0       OCC/UNOCC SUBR ADDRESS
0115  4C3B 0000             TEMP   DATA   0
0116  4C3C 0000             FLAG   DATA   0       PASS FLAG
0117  4C3D 0000             CNT    DATA   0       INPUT COUNT
0118                        *
0119  4C3E 0010             SXTEN  DATA   16
0120  4C3F FFFC             MFOUR  DATA   -4

0122                        *
0123                        *
0124                        *        TRACK CIRCUIT BECAME OCCUPIED SUBROUTINE
0125                        *
0126                        *        THIS ROUTINE CHECKS THE PREVIOUS TK CKT
0127                        *        FOR OCCUPANCY
0128                        *
0129                        *        IF OCCUPIED, THE TRAIN NUMBER IN THAT BLOCK
0130                        *        IS MOVED FORWARD INTO THE PRESENT BL
0131                        *
0132                        *        IF NOT OCCUPIED, A FALSE OCC WAS SEEN
0133                        *        A FALSE TRAIN NUMBER IS PUT IN THE
0134                        *        PRESENT BLOCK, AN ALARM BIT IS GENERA
0135                        *
0136                        *
0137  4C40 0800             TKOCR  ENT
0138  4C41 B60A 4C37                LDA    BIAS
0139  4C42 00D0                     DAR
0140  4C43 9A35 4C79                STA    TBIAS
0141  4C44 8A30 4C75                ADD    ATRLOC
0142  4C45 9A31 4C77                STA    STRTNO   PRESENT TRLOC ADD
0143  4C46 B232 4C79                LDA    TBIAS
0144  4C47 8A2C 4C74                ADD    ATABAD
0145  4C48 9A31 4C7A                STA    TTEMP    INFO TABLE ADD LOC
0146  4C49 B330 4C7A                LDA    *TTEMP
0147  4C4A 9A2D 4C78                STA    TBLADD
0148  4C4B B32C 4C78                LDA    *TBLADD  GET INFO WORD
0149  4C4C 3087 4C54                JAP    TOC1     NOT SW BLOCK
0150  4C4D 822D 4C7B                AND    SMSK     SW BLOCK
0151  4C4E FB2D 4C7C                CALL   *FETCH
0152  4C4F 3103 4C53                JAN    TOC2     SW IN POSITION
0153  4C50 B227 4C78                LDA    TBLADD   SW NOT IN POS
0154  4C51 0B05                     AAI    5
0155  4C52 9A25 4C78                STA    TBLADD
0156  4C53 DA24 4C78  TOC2          IMS    TBLADD
0157  4C54 B323 4C78  TOC1          LDA    *TBLADD  GET DIR WORD
0158  4C55 FB26 4C7C                CALL   *FETCH
0159  4C56 2102 4C59                JAZ    TOC3     EAST
0160  4C57 DA20 4C78                IMS    TBLADD   WEST
0161  4C58 DA1F 4C78                IMS    TBLADD
0162  4C59 DA1E' 4C78  TOC3         IMS    TBLADD
0163  4C5A B31D 4C78                LDA    *TBLADD  GET TK-1 WORD
0164  4C5B FB20 4C7C                CALL   *FETCH
0165  4C5C 2106 4C63                JAZ    TOC41    NOT OCC
0166  4C5D DA1A 4C78                IMS    TBLADD   OCC
0167  4C5E B319 4C78                LDA    *TBLADD  GET TRLOC-1
0168  4C5F 9A16 4C76                STA    ALOC
0169  4C60 B315 4C76                LDA    *ALOC
0170  4C61 9B15 4C77  TOC5          STA    *STRTNO  STORE TRAIN NUMBER
0171  4C62 F722 4C40                RTN    TKOCR
0172  4C63 DA14 4C78  TOC41         IMS    TBLADD   TK-1 NOT OCC
```

BEST AVAILABLE COPY

```
4C64 B313 4C78          LDA    *TBLADD  TRLOC-1 HAS TR#
4C65 9A10 4C76          STA    ALOC
4C66 B30F 4C76          LDA    *ALOC
4C67 31C6 4C61          JAG    TOC5     YES. USE TR#
4C68 B30E 4C77  TOC4    LDA    *STRTNO  NO. TK OCC ?
4C69 3148 4C61          JAN    TOC5     YES. RETURN
4C6A B213 4C7E          LDA    ABIT     BIT TABLE
4C6B 8E32 4C39          ADD    SHIFTC   BIAS
4C6C 0D01               SAI    1
4C6D 9A0F 4C7D          STA    ALBIT    ALARM BIT
4C6E B739 4C35          LDA    *ALARM
4C6F A30D 4C7D          IOR    *ALBIT   SET ALARM BIT
4C70 9F3B 4C35          STA    *ALARM
4C71 0110               ZAR
4C72 F97B 007B          CALL   *:7B     GET FALSE TRAIN #
4C73 F612 4C61          JMP    TOC5
                *
                *
4C74 4CAC       ATABAD DATA    TABADD   TABADD TABLE LOC
4C75 5000       ATRLOC DATA    TRLOC    TRLOC TABLE LOC
                *
4C76 0000       ALOC   DATA    0        TRLOC FROM INFO TABLE
4C77 0000       STRTNO DATA    0        TRLOC FROM TRACK ROUTINE
4C78 0000       TBLADD DATA    0        INFO TABLE POINTER
                *
4C79 0000       TBIAS  DATA    0        TRLOC/TABADD TABLE BIAS
4C7A 0000       TTEMP  DATA    0        FOR TABADD LOC STORAGE
                *
4C7B 7FFF       SMSK   DATA    :7FFF    SIGN MASK
                *
4C7C 5900       FETCH  DATA    :5900    FETCH SUBROUTINE ADDRESS
                *
4C7D 0000       ALBIT  DATA    0        BIT TO SET GIVEN ALARM
4C7E 0050       ABIT   DATA    :50
                *
                *
                *          TRACK CIRCUIT BECAME UNOCCUPIED SUBROUTINE
                *
                *          THIS ROUTINE CHECKS THE N+1 TRACK CIRCUIT
                *          FOR OCCUPANCY
                *
                *          IF OCCUPIED, THE TRAIN NUMBER IN THE PRAIT
                *          BLOCK IS ZEROED.
                *
                *          IF NOT OCCUPIED, A DROPOUT HAS BEEN FOUND
                *          AN ALARM BIT IS GENERATED
                *
                *
4C7F 0800       TN     ENT
4C80 B649 4C37          LDA    BIAS
4C81 0000               DAR
4C82 9E09 4C79          STA    TBIAS
4C83 8E0E 4C75          ADD    ATRLOC
4C84 9E0D 4C77          STA    STRTNO   PRESENT TRLOC ADDR LOC
4C85 B60C 4C79          LDA    TBIAS
4C86 9E12 4C74          ADD    ATABAD
4C87 9E0D 4C7A          STA    TTEMP    INFO TABLE ADD LOC
4C88 B705 4C7A          LDA    *TTEMP
4C89 9E11 4C78          STA    TBLADD   INFO TABLE ADDRESS
4C8A B712 4C78          LDA    *TBLADD  GET INFO WORD
4C8B 3087 4C93          JAP    TUN1     NOT SW BLOCK
4C8C 8611 4C7B          AND    SMSK     SW BLOCK
4C8D FF11 4C7C          CALL   *FETCH
4C8E 3100 4C92          JAN    TUN2     SW IN POSITION
4C8F B617 4C78          LDA    TBLADD   SW NOT IN POS
4C90 0005               AAI    5
```

```
0242  4C91 9E1A 4C78          STA   TBLADD
0243  4C92 D81A 4C78  TUN2    IMS   TBLADD
0244  4C93 B71A 4C78  TUN1    LDA   *TBLADD   GET DIR WORD
0245  4C94 FF1C 4C7C          CALL  *FETCH
0246  4C95 3102 4C98          JAN   TUN2      WRIT
0247  4C96 D81A 4C78          IMS   TBLADD    SAFT
0248  4C97 D81A 4C78          IMS   TBLADD
0249  4C98 D81A 4C78  TUN3    IMS   TBLADD
0250  4C99 B721 4C78          LDA   *TBLADD   GET TR+1 WORD
0251  4C9A FF1C 4C7C          CALL  *FETCH
0252  4C9B 2107 4C9F          JAZ   TUN4      NOT ACC
0253  4C9C 8110               ZAR   0         OCC
0254  4C9D 9E26 4C77  TUN5    STA   *STRTNO   STORE TRAIN NO.
0255  4C9E F71F 4C7F  TUN7    RTN   TBLADDR
0256  4C9F D827 4C78  TUN4    IMS   TBLADDR   TR+1 NOT OCC
0257  4CA0 B728 4C78          LDA   *TBLADDR  TBLOC+1 HAS TR#
0258  4CA1 9E2A 4C76          STA   PLOC
0259  4CA2 B720 4C76          LDA   *PLOC
0260  4CA3 3106 4C9D          JAG   TUN5      YES, ZERO TR OCC
0259  4CA4 B626 4C7E  TUN4    LDA   ABIT      NO, SET ALARM
0260  4CA5 8E6C 4C39          ADD   SHIFTC
0261  4CA6 0001               SAI   1
0262  4CA7 9E2A 4C7D          STA   ALBIT     ALARM BIT
0263  4CA8 B773 4C35          LDA   *ALARM    ALARM WORD
0264  4CA9 A72C 4C7D          IOR   *ALBIT    SET ALARM BIT
0265  4CAA 9F75 4C35          STA   *ALARM
0266  4CAB F60D 4C9E  TUN6    JMP   TUN7
0268                  *
0269                  *
0270                  *       TRAIN TRACKING LOCATION TABLE
0271                  *
0272                  *       ONE LOCATION IS USED FOR EACH TRACK
0273                  *       CIRCUIT.  IT CONTAINS THE NUMBER OF
0274                  *       ANY TRAIN OCCUPYING THAT CIRCUIT.
0275                  *
0276                  *
0277                  *       UNIDENTIFIED TRAINS WILL BE
0278                  *       NUMBERED FROM 99 DOWN.
0279                  *
0280                  *
0281  5000                    ABS   :5000
0282  5000 0000       TRLOC   DATA  0         SPARE
0283  5001 0000               DATA  0         SPARE
0284  5002 0000       TLOC1   DATA  0         1T
0285  5003 0000       TLOC2   DATA  0         2T
0286  5004 0000       TLOC3   DATA  0         3T
0287  5005 0000       TLOC4   DATA  0         4T
0288  5006 0000       TLOC5A  DATA  0         5AT
0289  5007 0000       TLOC5B  DATA  0         5BT
0290  5008 0000       TLOC6   DATA  0         6T
0291  5009 0000       TLOC7   DATA  0         7T
0292  500A 0000       TLOC8   DATA  0         8T
0293  500B 0000       TLOC9   DATA  0         9T
0294  500C 0000       TLOC10  DATA  0         10T
0295  500D 0000       TLOC11  DATA  0         11T
0296  500E 0000       TLOC12  DATA  0         12T
0297  500F 0000       TLOC13  DATA  0         13T
0298  5010 0000               DATA  0         SPARE
0299  5011 0000       TLOC14  DATA  0         14T
0300  5012 0000       TLOC15  DATA  0         15T
0301  5013 0000       TLOC16  DATA  0         16T
0302  5014 0000       TLOC17  DATA  0         17T
0303  5015 0000       TLOC18  DATA  0         18T
0304  5016 0000       TLOC19  DATA  0         19T
0305  5017 0000       TLOC20  DATA  0         20T
0306  5018 0000       TLC21A  DATA  0         21AT
```

BEST AVAILABLE COPY

```
0307  5019 0000        TLOC21B DATA  0        21BT
0308  501A   00        TLOC22  DATA  0        22T
0309  501B   00        TLOC23  DATA  0        22T
0310  501C   00        TLOC24  DATA  0        24T
0311  501D   00        TLOC25  DATA  0        25T
0312  501E 0000                DATA  0        SPARE
0313  501F 0000                DATA  0        SPARE
0314  5020 0000                DATA  0        SPARE
0315  5021 0000                DATA  0        SPARE
0316  5022 0000        TLOC26  DATA  0        26T
0317  5023 0000        TLOC27  DATA  0        27T
0318  5024 0000        TLOC28  DATA  0        28T

0319  5025 0000        TLOC29  DATA  0        29T
0320  5026 0000        TLOC30A DATA  0        30AT
0321  5027 0000        TLOC30B DATA  0        30BT
0322  5028 0000        TLOC31  DATA  0        31T
0323  5029 0000        TLOC32  DATA  0        32T
0324  502A 0000        TLOC33  DATA  0        33T
0325  502B 0000        TLOC34  DATA  0        34T
0326  502C 0000        TLOC35  DATA  0        35T
0327  502D 0000        TLOC36  DATA  0        36T
0328  502E 0000        TLOC37  DATA  0        37T
0329  502F 0000                DATA  0        SPARE
0330  5030 0000        TLOC38  DATA  0        38T
0331  5031 0000        TLOC39  DATA  0        39T
0332  5032 0000        TLOC40  DATA  0        40T
0333  5033 0000        TLOC41  DATA  0        41T
0334  5034 0000        TLOC42  DATA  0        42T
0335  5035 0000        TLOC43  DATA  0        43T
0336  5036 0000        TLOC44  DATA  0        44T
0337  5037 0000        TLOC45  DATA  0        45T
0338  5038 0000        TLOC46  DATA  0        46T
0339  5039 0000        TLOC47  DATA  0        47T
0340  503A 0000        TLOC48  DATA  0        48T
0341  503B 0000        TLOC49  DATA  0        49T
0342  503C 0000        TLOC50  DATA  0        50T
0343  503D 0000        TLOC51  DATA  0        51T
0344  503E 0000                DATA  0        SPARE
0345  503F 0000                DATA  0        SPARE
0346                   *
0347                   *
0348                   *          TABADD TABLE
0349                   *
0350                   *          THIS TABLE CONTAINS THE ADDRESSES
0351                   *          FOR EACH TRACK CIRCUIT TABLE USED
0352                   *          FOR TRAIN TRACKING
0353                   *
0354                   *
0355  4CAC                     ABS   TUN6+1
0356  4CAC 0000        TABADD DATA  0        SPARE
0357  4CAD 0000               DATA  0        SPARE
0358  4CAE 4CEC               DATA  TK1
0359  4CAF 4CF1               DATA  TK2
0360  4CB0 4CF6               DATA  TK3
0361  4CB1 4D01               DATA  TK4
0362  4CB2 4D0C               DATA  TK5A
0363  4CB3 4D11               DATA  TK5B
0364  4CB4 4D16               DATA  TK6
0365  4CB5 4D1B               DATA  TK7
0366  4CB6 4D20               DATA  TK8
0367  4CB7 4D25               DATA  TK9
0368  4CB8 4D2A               DATA  TK10
0369  4CB9 4D2F               DATA  TK11
0370  4CBA 4D34               DATA  TK12
0371  4CBB 4D39               DATA  TK13
0372
```

```
4CBC 0000          DATA   0        SPARE
4CBD 4D44          DATA   TK14
4CBE 4D49          DATA   TK15
4CBF 4D4E          DATA   TK16
4CC0 4D59          DATA   TK17
4CC1 4D5E          DATA   TK18
4CC2 4D63          DATA   TK19
4CC3 4D68          DATA   TK20
4CC4 4D6D          DATA   TK21A
4CC5 4D72          DATA   TK21B
4CC6 4D77          DATA   TK22
4CC7 4D82          DATA   TK23
4CC8 4D87          DATA   TK24
4CC9 4D8C          DATA   TK25
4CCA 0000          DATA   0        SPARE
4CCB 0000          DATA   0        SPARE
4CCC 0000          DATA   0        SPARE
4CCD 0000          DATA   0        SPARE
4CCE 4D97          DATA   TK26
4CCF 4D9C          DATA   TK27
4CD0 4DA1          DATA   TK28
4CD1 4DAC          DATA   TK29
4CD2 4DB7          DATA   TK30A
4CD3 4DBC          DATA   TK30B
4CD4 4DC1          DATA   TK31

4CD5 4DC6          DATA   TK32
4CD6 4DCB          DATA   TK33
4CD7 4DD0          DATA   TK34
4CD8 4DD5          DATA   TK35
4CD9 4DDA          DATA   TK36
4CDA 4DE5          DATA   TK37
4CDB 0000          DATA   0        SPARE
4CDC 4DEA          DATA   TK38
4CDD 4DEF          DATA   TK39
4CDE 4DFA          DATA   TK40
4CDF 4DFF          DATA   TK41
4CE0 4E04          DATA   TK42
4CE1 4E09          DATA   TK43
4CE2 4E0E          DATA   TK44
4CE3 4E13          DATA   TK45
4CE4 4E18          DATA   TK46
4CE5 4E1D          DATA   TK47
4CE6 4E28          DATA   TK48
4CE7 4E2D          DATA   TK49
4CE8 4E32          DATA   TK50
4CE9 4E3D          DATA   TK51
4CEA 0000          DATA   0        SPARE
4CEB 0000          DATA   0        SPARE
                 *
                 *
                 *        TRAIN TRACKING TABLES
                 *
                 *        THESE TABLES CONTAIN THE LOCATIONS IN
                 *        MEMORY WHERE SWITCH POSITIONS, TRACK
                 *        CIRCUITS, AND DIRECTION INPUTS FOR EACH
                 *        INDIVIDUAL TRACK CIRCUIT IS LOCATED.
                 *
                 *        THEY ALSO CONTAIN THE TRAIN LOCATION
                 *        TABLE ADDRESSES FOR ADJACENT TRACK CIR-
                 *        CUITS. THESE ARE REQUIRED TO MOVE A TRAIN
                 *        FROM ONE CIRCUIT TO ANOTHER.
                 *
                 *
4CEC 0B02        TK1    DATA   :0B02    DIR WORD BIT
4CED 0502               DATA   :0502    E   ZERO
4CEE 5001               DATA   TRLOC+1  TRLOC DUMMY
```

BEST AVAILABLE COPY

```
0440  4CEF 08C3          DATA   :08C3    W    2TK WORD BIT
0441  4CF0 5003          DATA   TLOC2    2TK  TRLOC
0442                *
0443  4CF1 0B02    TK2   DATA   :0B02    DIR  WORD BIT
0444  4CF2 08C2          DATA   :08C2    E    1TK
0445  4CF3 5002          DATA   TLOC1    1TK  TRLOC
0446  4CF4 08C4          DATA   :08C4    W    3TK
0447  4CF5 5004          DATA   TLOC3    3TK  TRLOC
0448                *
0449  4CF6 88A2    TK3   DATA   :88A2    SW1  WORD BIT NOR
0450  4CF7 0B02          DATA   :0B02    NOR  DIR WORD BIT
0451  4CF8 08C3          DATA   :08C3    E    2TK
0452  4CF9 5003          DATA   TLOC2    2TK  TRLOC
0453  4CFA 08C5          DATA   :08C5    W    4TK
0454  4CFB 5005          DATA   TLOC4    4TK  TRLOC
0455  4CFC 0B02          DATA   :0B02    REV  DIR WORD BIT
0456  4CFD 08C3          DATA   :08C3    E    2TK
0457  4CFE 5003          DATA   TLOC2    2TK  TRLOC
0458  4CFF 08E4          DATA   :08E4    W    28TK
0459  4D00 5024          DATA   TLOC28   28TK TRLOC
0460                *
0461  4D01 88A4    TK4   DATA   :88A4    SW3  WORD BIT NOR
0462  4D02 0B03          DATA   :0B03    NOR  DIR WORD BIT
0463  4D03 08C4          DATA   :08C4    E    3TK
0464  4D04 5004          DATA   TLOC3    3TK  TRLOC
0465  4D05 08C6          DATA   :08C6    W    5ATK
0466  4D06 5006          DATA   TLOC5A   5ATK TRLOC
0467  4D07 0B03          DATA   :0B03    REV  DIR WORD BIT
0468  4D08 08E5          DATA   :08E5    E    29TK
0469  4D09 5025          DATA   TLOC29   29TK TRLOC
0470  4D0A 08C6          DATA   :08C6    W    5ATK
0471  4D0B 5006          DATA   TLOC5A   5ATK TRLOC
0472                *
0473  4D0C 0B04    TK5A  DATA   :0B04    DIR  WORD BIT
0474  4D0D 08C5          DATA   :08C5    E    4TK
0475  4D0E 5005          DATA   TLOC4    4TK  TRLOC
0476  4D0F 08C7          DATA   :08C7    W    5BTK
0477  4D10 5007          DATA   TLOC5B   5BTK TRLOC
0478                *
0479  4D11 0B04    TK5B  DATA   :0B04    DIR  WORD BIT
0480  4D12 08C6          DATA   :08C6    E    5ATK
0481  4D13 5006          DATA   TLOC5A   5ATK TRLOC
0482  4D14 08C8          DATA   :08C8    W    6TK
0483  4D15 5008          DATA   TLOC6    6TK  TRLOC
0484                *
0485  4D16 0B04    TK6   DATA   :0B04    DIR  WORD BIT
0486  4D17 08C7          DATA   :08C7    E    5BTK
0487  4D18 5007          DATA   TLOC5B   5BTK TRLOC
0488  4D19 08C9          DATA   :08C9    W    7TK
0489  4D1A 5009          DATA   TLOC7    7TK  TRLOC
0490                *
0491  4D1B 0B04    TK7   DATA   :0B04    DIR  WORD BIT
0492  4D1C 08C8          DATA   :08C8    E    6TK
0493  4D1D 5008          DATA   TLOC6    6TK  TRLOC
0494  4D1E 08CA          DATA   :08CA    W    8TK
0495  4D1F 500A          DATA   TLOC8    8TK  TRLOC
0496                *
0497  4D20 0B04    TK8   DATA   :0B04    DIR  WORD BIT
0498  4D21 08C9          DATA   :08C9    E    7TK
0499  4D22 5009          DATA   TLOC7    7TK  TRLOC
0500  4D23 08CB          DATA   :08CB    W    9TK
0501  4D24 500B          DATA   TLOC9    9TK  TRLOC
0502                *
0503  4D25 0B04    TK9   DATA   :0B04    DIR  WORD BIT
0504  4D26 08CA          DATA   :08CA    E    8TK
0505  4D27 500A          DATA   TLOC8    8TK  TRLOC
```

BEST AVAILABLE COPY

```
4D28 08CC          DATA   :08CC    W   10TK
4D29 500C          DATA   TLOC10   10TK TRLOC
                 *
4D2A 0B04   TK10   DATA   :0B04    DIR WORD.BIT
4D2B 08CB          DATA   :08CB    E   9TK
4D2C 500B          DATA   TLOC9    9TK TRLOC
4D2D 08CD          DATA   :08CD    W   11TK
4D2E 500D          DATA   TLOC11   11TK TRLOC
                 *
4D2F 0B04   TK11   DATA   :0B04    DIR WORD.BIT
4D30 08CC          DATA   :08CC    E   10TK
4D31 500C          DATA   TLOC10   10TK TRLOC
4D32 08CE          DATA   :08CE    W   12TK
4D33 500E          DATA   TLOC12   12TK TRLOC
                 *
4D34 0B04   TK12   DATA   :0B01    DIR WORD.BIT
4D35 08CD          DATA   :08CD    E   11TK
4D36 500D          DATA   TLOC11   11TK TRLOC
4D37 08CF          DATA   :08CF    W   13TK
4D38 500F          DATA   TLOC13   13TK TRLOC
                 *
4D39 88A6   TK13   DATA   :88A6    SW5 WORD.BIT NOR
4D3A 0B05          DATA   :0B05    NOR DIR WORD.BIT
4D3B 08CE          DATA   :08CE    E   12TK
4D3C 500E          DATA   TLOC12   12TK TRLOC
4D3D 08D1          DATA   :08D1    W   14TK
4D3E 5011          DATA   TLOC14   14TK TRLOC
4D3F 0B05          DATA   :0B05    REV DIR WORD.BIT
4D40 08CE          DATA   :08CE    E   12TK
4D41 500E          DATA   TLOC12   12TK TRLOC
4D42 08D2          DATA   :08D2    W   15TK
4D43 5012          DATA   TLOC15   15TK TRLOC
                 *
4D44 0B06   TK14   DATA   :0B06    DIR WORD.BIT
4D45 08CF          DATA   :08CF    E   13TK
4D46 500F          DATA   TLOC13   13TK TRLOC
4D47 08D3          DATA   :08D3    W   16TK
4D48 5013          DATA   TLOC16   16TK TRLOC
                 *
4D49 0B07   TK15   DATA   :0B07    DIR WORD.BIT
4D4A 08CF          DATA   :08CF    E   13TK
4D4B 500F          DATA   TLOC13   13TK TRLOC
4D4C 08D3          DATA   :08D3    W   16TK
4D4D 5013          DATA   TLOC16   16TK TRLOC
                 *
4D4E 88A8   TK16   DATA   :88A8    SW7 WORD.BIT NOR
4D4F 0B08          DATA   :0B08    NOR DIR WORD.BIT
4D50 08D1          DATA   :08D1    E   14TK
4D51 5011          DATA   TLOC14   14TK TRLOC
4D52 08D4          DATA   :08D4    W   17TK
4D53 5014          DATA   TLOC17   17TK TRLOC
4D54 0B08          DATA   :0B08    REV DIR WORD.BIT
4D55 08D2          DATA   :08D2    E   15TK
4D56 5012          DATA   TLOC15   15TK TRLOC
4D57 08D4          DATA   :08D4    W   17TK
4D58 5014          DATA   TLOC17   17TK TRLOC
                 *
4D59 0B09   TK17   DATA   :0B09    DIR WORD.BIT
4D5A 08D3          DATA   :08D3    E   16TK
4D5B 5013          DATA   TLOC16   16TK TRLOC
4D5C 08D5          DATA   :08D5    W   18TK
4D5D 5015          DATA   TLOC18   18TK TRLOC
                 *
4D5E 0B09   TK18   DATA   :0B09    DIR WORD.BIT
4D5F 08D4          DATA   :08D4    E   17TK
4D60 5014          DATA   TLOC17   17TK TRLOC
4D61 08D6          DATA   :08D6    W   19TK
```

```
4D62 5016          DATA   TLOC19   19TK TRLOC
                   *
4D63 0B09   TK19   DATA   :0B09    DIR WORD/BIT
4D64 08D5          DATA   :08D5    E   18TK
4D65 5015          DATA   TLOC18   18TK TRLOC
4D66 08D7          DATA   :08D7    W   20TK
4D67 5017          DATA   TLOC20   20TK TRLOC
                   *
4D68 0B09   TK20   DATA   :0B09    DIR WORD/BIT
4D69 08D6          DATA   :08D6    E   19TK
4D6A 5016          DATA   TLOC19   19TK TRLOC
4D6B 08D8          DATA   :08D8    W   21ATK
4D6C 501A          DATA   TLC21A   21ATK TRLOC
                   *
4D6D 0B09   TK21A  DATA   :0B09    DIR WORD/BIT
4D6E 08D7          DATA   :08D7    E   20TK
4D6F 5017          DATA   TLOC20   20TK TRLOC
4D70 08D9          DATA   :08D9    W   21BTK
4D71 501B          DATA   TLC21B   21BTK TRLOC
                   *
4D72 0B09   TK21B  DATA   :0B09    DIR WORD/BIT
4D73 08D8          DATA   :08D8    E   21ATK
4D74 501A          DATA   TLC21A   21ATK TRLOC
4D75 08DA          DATA   :08DA    W   22TK
4D76 501A          DATA   TLOC22   22TK TRLOC
                   *
4D77 88AA   TK22   DATA   :88AA    SW9 WORD/BIT NOR
4D78 0B0A          DATA   :0B0A    NOR DIR WORD/BIT
4D79 08D9          DATA   :08D9    E   21BTK
4D7A 501B          DATA   TLC21B   21BTK TRLOC
4D7B 08DB          DATA   :08DB    W   23TK
4D7C 501B          DATA   TLOC23   23TK TRLOC
4D7D 0B0A          DATA   :0B0A    REV DIR WORD/BIT
4D7E 08D9          DATA   :08D9    E   21BTK
4D7F 501B          DATA   TLC21B   21BTK TRLOC
4D80 08F9          DATA   :08F9    W   47TK
4D81 5039          DATA   TLOC47   47TK TRLOC
                   *
4D82 0B0B   TK23   DATA   :0B0B    DIR WORD/BIT
4D83 08DA          DATA   :08DA    E   22TK
4D84 501A          DATA   TLOC22   22TK TRLOC
4D85 08DC          DATA   :08DC    W   24TK
4D86 501C          DATA   TLOC24   24TK TRLOC
                   *
4D87 0B0B   TK24   DATA   :0B0B    DIR WORD/BIT
4D88 08DB          DATA   :08DB    E   23TK
4D89 501B          DATA   TLOC23   23TK TRLOC
4D8A 08DD          DATA   :08DD    W   25TK
4D8B 501D          DATA   TLOC25   25TK TRLOC
                   *
4D8C 88AC   TK25   DATA   :88AC    SW11 WORD/BIT NOR
4D8D 0B0C          DATA   :0B0C    NOR DIR WORD/BIT
4D8E 08DC          DATA   :08DC    E   24TK
4D8F 501C          DATA   TLOC24   24TK TRLOC
4D90 0502          DATA   :0502    W   ZERO
4D91 501E          DATA   TLOC25+1 TRLOC DUMMY
4D92 0B0C          DATA   :0B0C    REV DIR WORD/BIT
4D93 08DC          DATA   :08DC    E   24TK
4D94 501C          DATA   TLOC24   24TK TRLOC
4D95 08FC          DATA   :08FC    W   50TK
4D96 503C          DATA   TLOC50   50TK TRLOC
                   *
4D97 0B12   TK26   DATA   :0B12    DIR WORD/BIT
4D98 0502          DATA   :0502    E   ZERO
4D99 5021          DATA   TLOC26-1 TRLOC DUMMY
4D9A 08E3          DATA   :08E3    W   27TK
4D9B 5023          DATA   TLOC27   27TK TRLOC
```

BEST AVAILABLE COPY

```
0640                    *
0641  4D9C 0B12         TK27   DATA   :0B12    DIR WORD BIT
0642  4D9D 08E2                DATA   :08E2    E   26TK
0643  4D9E 5022                DATA   TLOC26   26TK TRLOC
0644  4D9F 08E4                DATA   :08E4    W   28TK
0645  4DA0 5024                DATA   TLOC28   28TK TRLOC
0646                    *
0647  4DA1 88A3         TK28   DATA   :88A3    SW2 WORD BIT NOR
0648  4DA2 0B13                DATA   :0B13    NOR DIR WORD BIT
0649  4DA3 08E3                DATA   :08E3    E   27TK
0650  4DA4 5023                DATA   TLOC27   27TK TRLOC
0651  4DA5 08E5                DATA   :08E5    W   29TK
0652  4DA6 5025                DATA   TLOC29   29TK TRLOC
0653  4DA7 0B13                DATA   :0B13    REV DIR WORD BIT
0654  4DA8 08C4                DATA   :08C4    E   3TK
0655  4DA9 5004                DATA   TLOC3    3TK TRLOC
0656  4DAA 08E5                DATA   :08E5    W   29TK
0657  4DAB 5025                DATA   TLOC29   29TK TRLOC
0658                    *
0659  4DAC 88A5         TK29   DATA   :88A5    SW4 WORD BIT NOR
0660  4DAD 0B13                DATA   :0B13    NOR DIR WORD BIT
0661  4DAE 08E4                DATA   :08E4    E   28TK
0662  4DAF 5024                DATA   TLOC28   28TK TLOC
0663  4DB0 08E6                DATA   :08E6    W   30ATK
0664  4DB1 502E                DATA   TLC30A   30ATK TRLOC
0665  4DB2 0B13                DATA   :0B13    REV DIR WORD BIT
0666  4DB3 08E4                DATA   :08E4    E   28TK
0667  4DB4 5024                DATA   TLOC28   28TK TRLOC
0668  4DB5 08C5                DATA   :08C5    W   4TK
0669  4DB6 5005                DATA   TLOC4    4TK TLOC
0670                    *
0671  4DB7 0B14         TK30A  DATA   :0B14    DIR WORD BIT
0672  4DB8 08E5                DATA   :08E5    E   29TK
0673  4DB9 5025                DATA   TLOC29   29TK TRLOC
0674  4DBA 08E7                DATA   :08E7    W   30BTK
0675  4DBB 5027                DATA   TLC30B   30BTK TRLOC
0676                    *
0677  4DBC 0B14         TK30B  DATA   :0B14    DIR WORD BIT
0678  4DBD 08E6                DATA   :08E6    E   30ATK
0679  4DBE 5026                DATA   TLC30A   30ATK TRLOC
0680  4DBF 08E8                DATA   :08E8    W   31TK
0681  4DC0 5028                DATA   TLOC31   31TK TRLOC
0682                    *
0683  4DC1 0B14         TK31   DATA   :0B14    DIR WORD BIT
0684  4DC2 08E7                DATA   :08E7    E   30BTK
0685  4DC3 5027                DATA   TLC30B   30BTK TRLOC
0686  4DC4 08E9                DATA   :08E9    W   32TK
0687  4DC5 5029                DATA   TLOC32   32TK TRLOC
0688                    *
0689  4DC6 0B14         TK32   DATA   :0B14    DIR WORD BIT
0690  4DC7 08E8                DATA   :08E8    E   31TK
0691  4DC8 5028                DATA   TLOC31   31TK TRLOC
0692  4DC9 08EA                DATA   :08EA    W   33TK
0693  4DCA 502A                DATA   TLOC33   33TK TRLOC
0694                    *
0695  4DCB 0B14         TK33   DATA   :0B14    DIR WORD BIT
0696  4DCC 08E9                DATA   :08E9    E   32TK
0697  4DCD 5029                DATA   TLOC32   32TK TRLOC
0698  4DCE 08EB                DATA   :08EB    W   34TK
0699  4DCF 502B                DATA   TLOC34   34TK TRLOC
0700                    *
0701  4DD0 0B14         TK34   DATA   :0B14    DIR WORD BIT
0702  4DD1 08EA                DATA   :08EA    E   33TK
0703  4DD2 502A                DATA   TLOC33   33TK TRLOC
0704  4DD3 08EC                DATA   :08EC    W   35TK
0705  4DD4 502C                DATA   TLOC35   35TK TRLOC
```

BEST AVAILABLE COPY

```
0706                    *
0707  4DD5 0B14        TK35   DATA   :0B14    DIR WORD,BIT
0708  4DD6 08EB               DATA   :08EB    E   34TK
0709  4DD7 502B               DATA   TLOC34   34TK TRLOC
0710  4DD8 08ED               DATA   :08ED    W   36TK
0711  4DD9 502D               DATA   TLOC36   36TK TRLOC
0712                    *
0713  4DDA 88A7        TK36   DATA   :88A7    SWS WORD,BIT NOR
0714  4DDB 0B15               DATA   :0B15    NOR DIR WORD,BIT
0715  4DDC 08EC               DATA   :08EC    E   35TK
0716  4DDD 502C               DATA   TLOC35   35TK TRLOC
0717  4DDE 08EE               DATA   :08EE    W   37TK
0718  4DDF 502E               DATA   TLOC37   37TK TRLOC
0719  4DE0 0B15               DATA   :0B15    REV DIR WORD,BIT
0720  4DE1 08EC               DATA   :08EC    E   35TK
0721  4DE2 502C               DATA   TLOC35   35TK TRLOC
0722  4DE3 08F0               DATA   :08F0    W   38TK
0723  4DE4 5030               DATA   TLOC38   38TK TRLOC
0724                    *
0725  4DE5 0B16        TK37   DATA   :0B16    DIR WORD,BIT
0726  4DE6 08ED               DATA   :08ED    E   36TK
0727  4DE7 502D               DATA   TLOC36   36TK TRLOC
0728  4DE8 08F1               DATA   :08F1    W   39TK
0729  4DE9 5031               DATA   TLOC39   39TK TRLOC
0730                    *
0731  4DEA 0B17        TK38   DATA   :0B17    DIR WORD,BIT
0732  4DEB 08ED               DATA   :08ED    E   36TK
0733  4DEC 502D               DATA   TLOC36   36TK TRLOC
0734  4DED 08F1               DATA   :08F1    W   39TK
0735  4DEE 5031               DATA   TLOC39   39TK TRLOC
0736                    *
0737  4DEF 88A9        TK39   DATA   :88A9    SWS WORD,BIT NOR
0738  4DF0 0B18               DATA   :0B18    NOR DIR WORD,BIT
0739  4DF1 08EE               DATA   :08EE    E   37TK
0740  4DF2 502E               DATA   TLOC37   37TK TRLOC
0741  4DF3 08F2               DATA   :08F2    W   40TK
0742  4DF4 5032               DATA   TLOC40   40TK TRLOC
0743  4DF5 0B18               DATA   :0B18    REV DIR WORD,BIT
0744  4DF6 08F0               DATA   :08F0    E   38TK
0745  4DF7 5030               DATA   TLOC38   38TK TRLOC
0746  4DF8 08F2               DATA   :08F2    W   40TK
0747  4DF9 5032               DATA   TLOC40   40TK TRLOC
0748                    *
0749  4DFA 0B19        TK40   DATA   :0B19    DIR WORD,BIT
0750  4DFB 08F1               DATA   :08F1    E   39TK
0751  4DFC 5031               DATA   TLOC39   39TK TRLOC
0752  4DFD 08F3               DATA   :08F3    W   41TK
0753  4DFE 5033               DATA   TLOC41   41TK TRLOC
0754                    *
0755  4DFF 0B19        TK41   DATA   :0B19    DIR WORD,BIT
0756  4E00 08F2               DATA   :08F2    E   40TK
0757  4E01 5032               DATA   TLOC40   40TK TRLOC
0758  4E02 08F4               DATA   :08F4    W   42TK
0759  4E03 5034               DATA   TLOC42   42TK TRLOC
0760                    *
0761  4E04 0B19        TK42   DATA   :0B19    DIR WORD,BIT
0762  4E05 08F3               DATA   :08F3    E   41TK
0763  4E06 5033               DATA   TLOC41   41TK TRLOC
0764  4E07 08F5               DATA   :08F5    W   43TK
0765  4E08 5035               DATA   TLOC43   43TK TRLOC
0766                    *
0767  4E09 0B19        TK43   DATA   :0B19    DIR WORD,BIT
0768  4E0A 08F4               DATA   :08F4    E   42TK
0769  4E0B 5034               DATA   TLOC42   42TK TRLOC
0770  4E0C 08F6               DATA   :08F6    W   44TK
0771  4E0D 5036               DATA   TLOC44   44TK TRLOC
```

BEST AVAILABLE COPY

```
0772
0773  4E0E 0B1A      TK44   DATA   :0B1A    DIR WORD BIT
0774  4E0F 08F5             DATA   :08F5    E   43TK
0775  4E10 5035             DATA   TLOC43   43TK TRLOC
0776  4E11 08F7             DATA   :08F7    W   45TK
0777  4E12 5037             DATA   TLOC45   45TK TRLOC
0778                 *
0779
0780  4E13 0B19      TK45   DATA   :0B19    DIR WORD BIT
0780  4E14 08F6             DATA   :08F6    E   44TK
0781  4E15 5036             DATA   TLOC44   44TK TRLOC
0782  4E16 08F8             DATA   :08F8    W   46TK
0783  4E17 5038             DATA   TLOC46   46TK TRLOC
0784
0785  4E18 0B19      TK46   DATA   :0B19    DIR WORD BIT
0786  4E19 08F7             DATA   :08F7    E   45TK
0787  4E1A 5037             DATA   TLOC45   45TK TRLOC
0788  4E1B 08F9             DATA   :08F9    W   47TK
0789  4E1C 5039             DATA   TLOC47   47TK TRLOC
0790                 *
0791  4E1D 88AB      TK47   DATA   :88AB    SW10 WORD BIT NOR
0792  4E1E 0B1A             DATA   :0B1A    NOR DIR WORD BIT
0793  4E1F 08F8             DATA   :08F8    E   46TK
0794  4E20 5038             DATA   TLOC46   46TK TRLOC
0795  4E21 08FA             DATA   :08FA    W   48TK
0796  4E22 503A             DATA   TLOC48   48TK TRLOC
0797  4E23 0B1A             DATA   :0B1A    REV DIR WORD BIT
0798  4E24 08DA             DATA   :08DA    E   22TK
0799  4E25 501A             DATA   TLOC22   22TK TRLOC
0800  4E26 08FA             DATA   :08FA    W   48TK
0801  4E27 503A             DATA   TLOC48   48TK TRLOC
0802                 *
0803  4E28 0B1B      TK48   DATA   :0B1B    DIR WORD BIT
0804  4E29 08F9             DATA   :08F9    E   47TK
0805  4E2A 5039             DATA   TLOC47   47TK TRLOC
0806  4E2B 08FB             DATA   :08FB    W   49TK
0807  4E2C 503B             DATA   TLOC49   49TK TRLOC
0808                 *
0809  4E2D 0B1B      TK49   DATA   :0B1B    DIR WORD BIT
0810  4E2E 08FA             DATA   :08FA    E   48TK
0811  4E2F 503A             DATA   TLOC48   48TK TRLOC
0812  4E30 08FC             DATA   :08FC    W   50TK
0813  4E31 503C             DATA   TLOC50   50TK TRLOC
0814                 *
0815  4E32 88AB      TK50   DATA   :88AB    SW10 WORD BIT NOR
0816  4E33 0B1C             DATA   :0B1C    NOR DIR WORD BIT
0817  4E34 08FB             DATA   :08FB    E   49TK
0818  4E35 503B             DATA   TLOC49   49TK TRLOC
0819  4E36 08FD             DATA   :08FD    W   51TK
0820  4E37 503D             DATA   TLOC51   51TK TRLOC
0821  4E38 0B1C             DATA   :0B1C    REV DIR WORD BIT
0822  4E39 08DD             DATA   :08DD    E   25TK
0823  4E3A 501D             DATA   TLOC25   25TK TRLOC
0824  4E3B 08FD             DATA   :08FD    W   51TK
0825  4E3C 503D             DATA   TLOC51   51TK TRLOC
0826                 *
0827  4E3D 0B1D      TK51   DATA   :0B1D    DIR WORD BIT
0828  4E3E 08FC             DATA   :08FC    E   50TK
0829  4E3F 503C             DATA   TLOC50   50TK TRLOC

0830  4E40 0502             DATA   :0502    W   ZERO
0831  4E41 50C0             DATA   TLOC50+1 TRLOC DUMMY
0832                 *
0833  580F                 REF    :580F
0834  580F 4000             DATA   TRPC+
0835
0836                       END
```

I claim:

1. In apparatus for tracking the movement of a train including at least one vehicle along a roadway track including a plurality of signal blocks, the combination of first means for determining an occupancy of each signal block by said train, second means for determining an unoccupancy of each signal block by said train, and third means responsive to each said occupancy and to each said unoccupancy for establishing a record of the position of said train in relation to each of said signal blocks of the roadway track.

2. The apparatus of claim 1 for a train including a plurality of vehicles moving along the roadway track, with the first means determining the occupancy of each signal block by any of said vehicles, with the second means determining the unoccupancy of each signal block by any of said vehicles, and with the third means establishing said position record in relation to each signal block and the movement of each said vehicle.

3. The apparatus of claim 1, with said occupancy resulting from said train's entering a signal block and with said unoccupancy resulting from said train's leaving a signal block.

4. The apparatus of claim 1, with said third means detecting the movement direction of said train in relation to at least one signal block.

5. The apparatus of claim 1, with said third means detecting at least one of a false occupancy condition (wherein on occupancy of a signal block, it is determined the previous signal block was unoccupied) and a dropout condition (wherein on unoccupancy of a signal block, it is determined the succeeding signal block is unoccupied) in relation to each of said signal blocks.

6. The apparatus of claim 1, with said third means changing said train movement position in said record on a signal block by signal block basis.

7. The apparatus of claim 1, with said roadway track including a gate, and with said position record having a bit for at least one signal block adjacent to that gate and which bit is set in accordance with the clearing of that gate.

8. The apparatus of claim 1, with said position record including a bit for each signal block to indicate the direction of train travel determined for that signal block.

9. The apparatus of claim 1, with said position record including a first change record for indicating when any signal block becomes occupied and a second change record for indicating when any signal block becomes unoccupied.

10. The apparatus of claim 1, and including means for checking when a given signal block becomes occupied by said train to see if the position record for the previous signal block indicates said previous signal block was occupied by said train for determining if the occupancy of said given signal block is a desired operation of said train.

11. The apparatus of claim 1, including means for providing an alarm when a given signal block becomes occupied and both of the previous signal block and the position record for the previous signal block establish unoccupancy of that previous signal block by the same train moving along the roadway track.

12. The apparatus of claim 1, including means for checking when a given signal block becomes unoccupied to see if at least one of the next signal block and the position record for the next signal block in relation to the known train movement indicates the next signal block is occupied and for providing an alarm when that next signal block is not occupied.

13. The apparatus of claim 1 including a digital computer operative in a plurality of predetermined program cycles, with the first, second and third means being operative each said program cycle for updating the established position record in response to each signal block becoming one of occupied and unoccupied by said train moving along the roadway track.

14. The apparatus of claim 1, with the position of the third means establishing said position record to indicate the train location by having an identification number for said train and with the position of said number being changed in relation to each signal block that becomes occupied by said train.

15. The method of tracking the movement of a vehicle along a roadway track including a plurality of signal blocks, the steps of detecting an occupancy of any signal block by said vehicle, detecting an unoccupancy of any signal block by said vehicle and establishing in response to each said occupancy and to each said unoccupancy a position record in accordance with the movement of said vehicle in relation to each of said signal blocks of the roadway track.

16. The method of claim 15 for tracking a plurality of vehicles moving along the roadway track, including detecting said occupancy of any signal block by each of said vehicles, detecting said unoccupancy of any signal block by each of said vehicles, and establishing a position record for the movement of each said vehicle.

17. The method of claim 15, with said occupancy resulting from the vehicle entering a signal block and with said unoccupancy resulting from the vehicle leaving a signal block.

18. The method of claim 15, including detecting at least one of a false occupancy condition where a present signal block becomes occupied and the next signal block is not occupied by the vehicle and a dropout condition where a present signal block is not occupied and a previous signal block was occupied by the vehicle in relation to each of said signal blocks.

19. The method of claim 15, with said position record including a bit for each signal block to indicate the direction of vehicle travel determined for that signal block.

20. The method of claim 15, with said position record indicating when any signal block becomes occupied and indicating when any signal block becomes unoccupied.

21. The method of claim 15, including checking when a present signal block becomes occupied to see if the previous signal block was occu-

BEST AVAILABLE COPY pied for determining whether a desired occupancy of said present signal block has occurred.

22. The method of claim 15, including providing an alarm when a present signal block becomes occupied and the previous signal block in relation to vehicle movement was not occupied by the same vehicle.

23. The method of claim 15, including checking when a present signal block becomes unoccupied to see if the next successive signal block in relation to the known vehicle movement is occupied and providing an alarm when that next signal block is not so occupied.

24. The method of claim 15 operative in a plurality of predetermined program time cycles, and including being operative each said program cycle for updating the established position record in response to each signal block becoming one of occupied and unoccupied by said vehicle moving along the roadway track.

25. The method of claim 15, including establishing said vehicle position record having an identification number for said vehicle, with the position of said number being changed in said record in accordance with the vehicle movement and in relation to each signal block that becomes occupied by said vehicle.

* * * * *